US010996604B2

(12) United States Patent
Seki et al.

(10) Patent No.: US 10,996,604 B2
(45) Date of Patent: May 4, 2021

(54) IMAGE FORMING APPARATUS CONFIGURED TO DIAGNOSE FAILURE

(71) Applicant: CANON KABUSHIKI KAISHA, Tokyo (JP)

(72) Inventors: Satoshi Seki, Tokyo (JP); Naoto Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/742,273

(22) Filed: Jan. 14, 2020

(65) Prior Publication Data

US 2020/0233356 A1 Jul. 23, 2020

(30) Foreign Application Priority Data

Jan. 18, 2019 (JP) ..... JP2019-007380

(51) Int. Cl.
*G03G 15/00* (2006.01)

(52) U.S. Cl.
CPC ..... *G03G 15/5054* (2013.01); *G03G 15/55* (2013.01); *G03G 15/70* (2013.01)

(58) Field of Classification Search
CPC ..... G03G 15/5054; G03G 15/55; G03G 15/70
See application file for complete search history.

(56) References Cited

U.S. PATENT DOCUMENTS

2018/0004148 A1* 1/2018 Kanno ..... G03G 15/70
2018/0246460 A1* 8/2018 Sugano ..... G03G 15/70
2019/0310804 A1* 10/2019 Fukuda ..... G03G 15/55

FOREIGN PATENT DOCUMENTS

JP 2005-237046 A 9/2005

* cited by examiner

*Primary Examiner* — Sophia S Chen
(74) *Attorney, Agent, or Firm* — Canon U.S.A., Inc. I.P. Division

(57) ABSTRACT

An image forming apparatus includes a controller, a conveyance unit, and an image forming unit to form an image on a sheet conveyed by the conveyance unit along a conveyance path. The controller controls to stop conveyance by the conveyance unit where a first abnormality is detected in the image forming apparatus, and controls to execute first determining processing for determining a failure portion that is a cause of the first abnormality. The controller controls to stop conveyance by the conveyance unit where a second abnormality is detected in the image forming apparatus, and controls to execute second determining processing for determining a failure portion that is a cause of the second abnormality. The first determining processing is executed without outputting announce information for prompting removal of a sheet remaining in the conveyance path. The controller outputs the announce information and executes the second determining processing.

18 Claims, 17 Drawing Sheets

FIG.4

| OBJECT TO BE DIAGNOSED | POWER SUPPLY PORTION | SIGNAL OUTPUT PORTION | CONTROL CIRCUIT PORTION | LOAD OPERATION PORTION |
|---|---|---|---|---|
| ATTACHMENT/ DETACHMENT MOTOR | +24V_B_FU | MOTOR CONTROL SIGNAL | SEPARATION MOTOR DRIVING CIRCUIT | INTERMEDIATE TRANSFER BELT ATTACHMENT/ DETACHMENT MECHANISM |
| FAN MOTOR | +24V_B_FU | MOTOR CONTROL SIGNAL | FAN MOTOR DRIVING CIRCUIT | FAN |
| MONOCHROME DRUM MOTOR | +24V_B_FU | MOTOR CONTROL SIGNAL | MONOCHROME DRUM MOTOR DRIVING CIRCUIT | MONOCHROME PHOTOSENSITIVE DRUM |
| COLOR DRUM MOTOR | +24V_B_FU | MOTOR CONTROL SIGNAL | COLOR DRUM MOTOR DRIVING CIRCUIT | COLOR PHOTOSENSITIVE DRUM |
| FIXING MOTOR | +24V_B_FU | MOTOR CONTROL SIGNAL | FIXING MOTOR DRIVING CIRCUIT | FIXING UNIT |
| CHARGING DC OUTPUT | +24V_A_FU | HIGH-VOLTAGE CONTROL SIGNAL | CHARGING DC HIGH-VOLTAGE CIRCUIT | CHARGING ROLLER |
| DEVELOPMENT DC OUTPUT | +24V_A_FU | HIGH-VOLTAGE CONTROL SIGNAL | DEVELOPMENT DC HIGH-VOLTAGE CIRCUIT | DEVELOPING UNIT |
| PRIMARY TRANSFER DC OUTPUT | +24V_A_FU | HIGH-VOLTAGE CONTROL SIGNAL | PRIMARY TRANSFER DC HIGH-VOLTAGE CIRCUIT | PRIMARY TRANSFER ROLLER |
| SECONDARY TRANSFER DC OUTPUT | +24V_A_FU | HIGH-VOLTAGE CONTROL SIGNAL | SECONDARY TRANSFER DC HIGH-VOLTAGE CIRCUIT | SECONDARY TRANSFER ROLLER |

MONOCHROME ATTACHMENT POSITION

FULL-COLOR ATTACHMENT POSITION

FULL-COLOR DETACHMENT POSITION

FIG.12

| ERROR CODE | FAILURE DIAGNOSIS TYPE | ABNORMALITY DETECTION CONTENTS |
|---|---|---|
| E001 | 1 | DEVELOPING UNIT (YELLOW) TONER DENSITY ABNORMALITY |
| E002 | 1 | DEVELOPING UNIT (MAGENTA) TONER DENSITY ABNORMALITY |
| E003 | 1 | DEVELOPING UNIT (CYAN) TONER DENSITY ABNORMALITY |
| E004 | 1 | DEVELOPING UNIT (BLACK) TONER DENSITY ABNORMALITY |
| E005 | 1 | FAN ROTATION ABNORMALITY |
| E006 | 2 | INTERMEDIATE TRANSFER BELT ATTACHMENT/DETACHMENT MECHANISM ABNORMALITY |
| E007 | 1 | MONOCHROME DRUM MOTOR ROTATION ABNORMALITY |
| E008 | 1 | COLOR DRUM MOTOR ROTATION ABNORMALITY |
| E009 | 1 | FIXING MOTOR ROTATION ABNORMALITY |
| * | * | * |

IMAGE FORMING APPARATUS CONFIGURED TO DIAGNOSE FAILURE

BACKGROUND

Field

The present disclosure relates to diagnosis processing for diagnosing a failure in an image forming apparatus.

Description of the Related Art

An image forming apparatus conveys a sheet fed from a tray or cassette along a conveyance path and forms an image on the sheet to create an output product. Such an image forming apparatus includes a power supply circuit that supplies a voltage to a plurality of motors and a plurality of units. However, if a desired operation is not executed by the motors, or if a desired voltage is not supplied from the rawer supply circuit, the image forming apparatus may not form an ideal image on a sheet. Japanese Patent Application Laid-Open No. 2005-237046 discusses a failure diagnosis technique in which, if an abnormality in any unit of the image forming apparatus is detected, an image formation operation is interrupted to make a diagnosis of any failure location. If the failure location is identified in the diagnosis operation, a service person performs repair or replacement on the failure location.

SUMMARY

Sequences in the failure diagnosis technique discussed in Japanese Patent Application Laid-Open No. 2005-237046 have the following issue. In the case of setting a driving portion of the image forming apparatus in motion in a failure diagnosis operation to identify a failure location, a sheet remaining in a conveyance path is forcibly conveyed, which may damage the sheet or the image forming apparatus.

According to an aspect of the present disclosure, an image forming apparatus includes a conveyance unit configured to convey a sheet along a conveyance path, an image forming unit configured to form an image, an intermediate transfer member onto which the image is transferred, wherein the intermediate transfer member is rotationally driven, a transfer unit configured to transfer the image on the intermediate transfer member onto the sheet, a display configured to display a screen for prompting removal of a sheet remaining in the conveyance path, and a controller configured to control to perform operations including: detecting an abnormality in the image forming apparatus, determining whether a failure has occurred in the image forming apparatus based on a detection result of detecting an abnormality, executing, in a case where it is determined that a failure has occurred in the image forming apparatus, interruption processing for interrupting (i) an image formation operation in which the image forming unit forms an image, (ii) a conveyance control operation in which the conveyance unit conveys a sheet, and (iii) a rotational driving operation in which the intermediate transfer member is rotated, selecting a type of failure diagnosis operation based on the abnormality detection result, and executing the selected failure diagnosis operation to diagnose a cause of the failure after the interruption processing is executed, wherein, in a case where the failure diagnosis operation of a first type is selected, executing includes executing the failure diagnosis operation of the first type without rotating the intermediate transfer member and without causing the display to display the screen for prompting removal of a sheet remaining in the conveyance path, and wherein, in a case where the failure diagnosis operation of a second type is selected, executing includes (a) causing the display to display the screen for prompting removal of a sheet remaining in the conveyance path, and (b) executing the failure diagnosis operation of the second type by rotating the intermediate transfer member after the sheet remaining in the conveyance path is removed.

Further features of the present disclosure will become apparent from the following description of exemplary embodiments with reference to the attached drawings.

BRIEF DESCRIPTION OF THE DRAWINGS

FIG. 4 illustrates an electric failure diagnosis table.

FIG. 12 is a table illustrating a correspondence relationship between error codes and failure diagnosis types.

DESCRIPTION OF THE EMBODIMENTS

Figure 1:
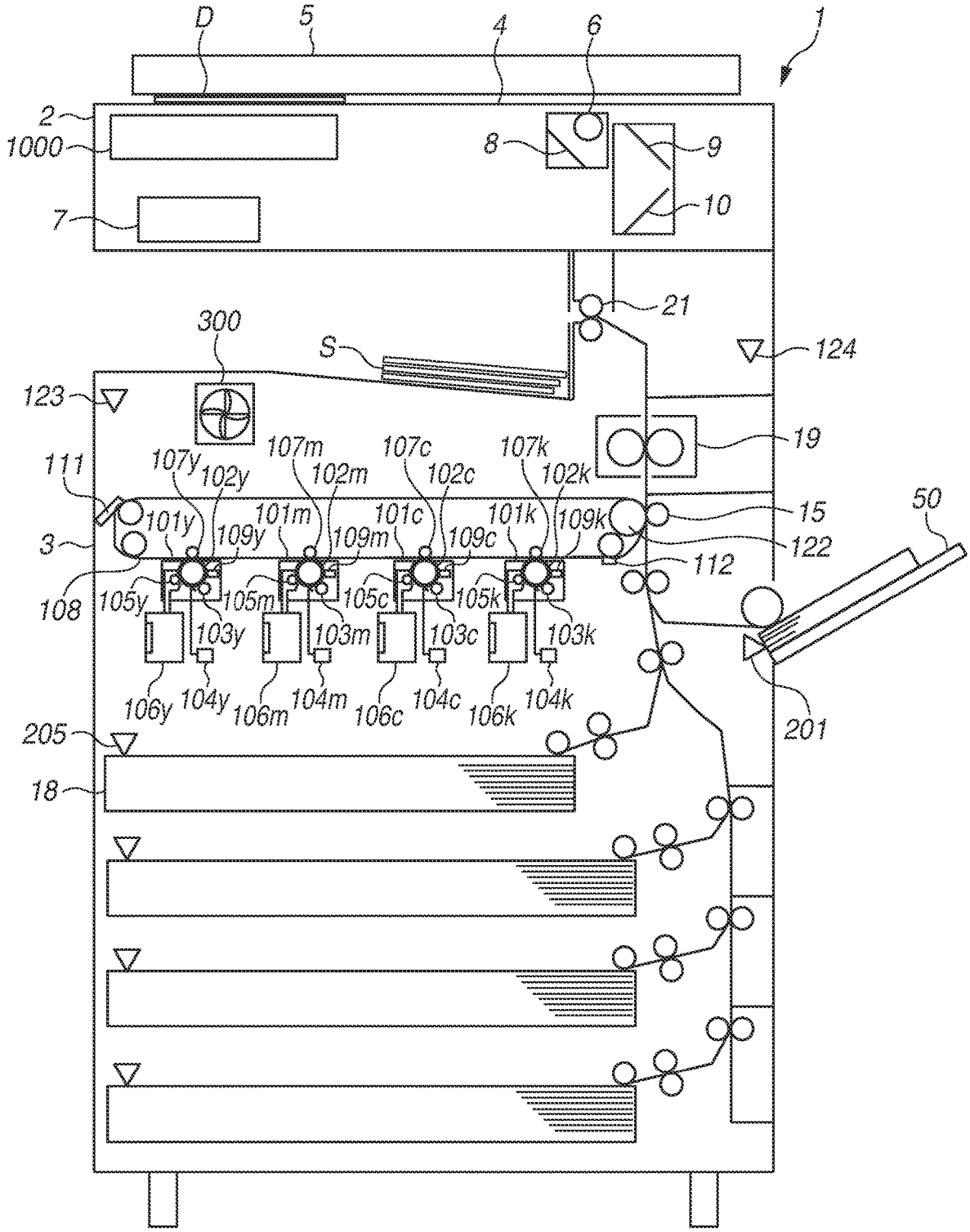
FIG. 1 is a schematic sectional view illustrating an image forming apparatus.

FIG. 1 is a schematic sectional view illustrating an image forming apparatus 1. The image forming apparatus 1 includes an image reading portion 2 and an image forming portion 3. A platen glass 4, which is a transparent glass plate, is provided at an upper portion of the image reading portion 2. A pressure plate 5 is a cover that is opened or closed by a user so that a document D, which is placed with an image surface facing downward at a predetermined position of the platen glass 4, is pressed against the platen glass 4. An optical system including a lamp 6 and reflection mirrors 8, 9, and 10 is provided below the platen glass 4. The lamp 6 illuminates the document D. The reflection mirrors 8, 9, and 10 guide an optical image on the illuminated document D to an image processing unit 7. The lamp 6 and the reflection mirrors 8, 9, and 10 move at a predetermined speed to scan the document D.

The image reading portion 2 includes an operation panel 1000. The operation panel 1000 sends information about an abnormality or failure to a user or service person, and displays a screen for prompting the user or service person to remove a jammed sheet on a display. The operation panel 1000 includes not only the display, but also a keypad for inputting the number of copies, and selection keys for selecting a print sheet type. According to an exemplary embodiment of the present disclosure, the image forming apparatus 1 has a structure in which the operation panel 1000 is provided in the image reading portion 2. However, the operation panel 1000 may be provided in the image forming portion 3.

The image forming portion 3 includes process units 101*y*, 101*m*, 101*c*, and 101*k*. The process units 101*y*, 101*m*, 101*c*, and 101*k* form toner images using yellow (y), magenta (m), cyan (c), and black (k) developing materials, respectively. The toner images formed by the process units 101*y*, 101*m*, 101*c*, and 101*k* are primarily transferred onto an intermediate transfer belt 108. The toner images of the respective colors superimposed on the intermediate transfer belt 108 are conveyed by the intermediate transfer belt 108, and transferred onto a print sheet S (sheet) at a portion (transfer nip portion) between a drive roller 122 and a secondary transfer roller 15. The process units 101*y*, 101*m*, 101*c*, and 101*k* each include a photosensitive drum 102, a charging roller 103, a laser exposure device 104, a developing unit 105, a toner container 106, and a drum cleaner 109. In FIG. 1, characters "y", "m", "c", and "k" corresponding to the respective colors are added to ends of the reference numerals. The image forming apparatus 1 according to the present exemplary embodiment has a structure in which an electrostatic latent image is formed on the photosensitive drum 102, but instead may have a structure in which, for example, an electrostatic latent image is formed on a photosensitive belt. The photosensitive drum 102 and the photosensitive belt are examples of a photosensitive member. The image forming portion 3 also includes primary transfer rollers 107*y*, 107*m*, 107*c*, and 107*k*, the intermediate transfer belt 108, a density sensor 112, the secondary transfer roller 15, and a belt cleaner 111. The image forming apparatus 1 according to the present exemplary embodiment primarily transfers the images onto the intermediate transfer belt 108. The image forming apparatus 1 may primarily transfer the images onto an intermediate transfer drum, instead of primarily transferring the images onto the intermediate transfer belt 108. The intermediate transfer belt 108 and the intermediate transfer drum are examples of an intermediate transfer member onto which an image is transferred.

Each print sheet S placed on a cassette 18 or a tray 50 is fed by a pickup roller of the image forming portion 3. A sheet detection sensor 201 is a sensor that detects whether the print sheet S is placed on the tray 50. A sheet detection sensor 205 is a sensor that detects whether the print sheet S is stored in the cassette 18.

A fixing unit 19 includes a heater. The fixing unit 19 heats the toner images formed on the print sheet S, to fix the toner images onto the print sheet S. The print sheet S on which the toner images are fixed by the fixing unit 19 is discharged from the image forming portion 3 by a discharge roller pair 21. A fan 300 releases heat generated in the image forming portion 3 to the outside of the image forming portion 3.

A front surface of the image forming portion 3 is provided with a front cover (not illustrated). The user or service person opens the front cover to replace a consumable such as the photosensitive drum 102 or the developing unit 105. The image forming portion 3 interrupts driving of a member, such as a gear or a roller, upon detection of an opened state of the front cover. Accordingly, the image forming apparatus 1 includes an opening/closing detection sensor 123 that detects the opened state or closed state of the front cover. A right side surface of the image forming portion 3 is provided with a right cover (not illustrated). The user or service person opens the right cover to replace the intermediate transfer belt 108, or to remove a jammed sheet. Accordingly, the image forming apparatus 1 includes an opening/closing detection sensor 124 that detects the opened state or closed state of the right cover.

(Attachment/Detachment Mechanism)

The image forming apparatus 1 includes an attachment/detachment mechanism 118 that controls the intermediate transfer belt 108 and the photosensitive drums 102*y*, 102*m*, 102*c*, and 102*k* to enter a first contact state, a second contact state, or a separation state. The first contact, the second contact state, and the separation state will now be described with reference to schematic diagrams illustrated in FIGS. 8A to 8C.

The attachment/detachment mechanism 118 includes an attachment/detachment motor 603, a home position flag 243, and a home position detection sensor 242. The attachment/detachment motor 603 is a stepping motor. The home position flag 243 is provided on a rotating shaft of the attachment/detachment motor 603. The home position detection sensor 242 detects the home position flag 243. The image forming apparatus 1 determines the contact/separation state between the intermediate transfer belt 108 and the photosensitive drums 102*y*, 102*m*, 102*c*, and 102*k* based on a detection signal from the home position detection sensor 242.

Figure 8A:
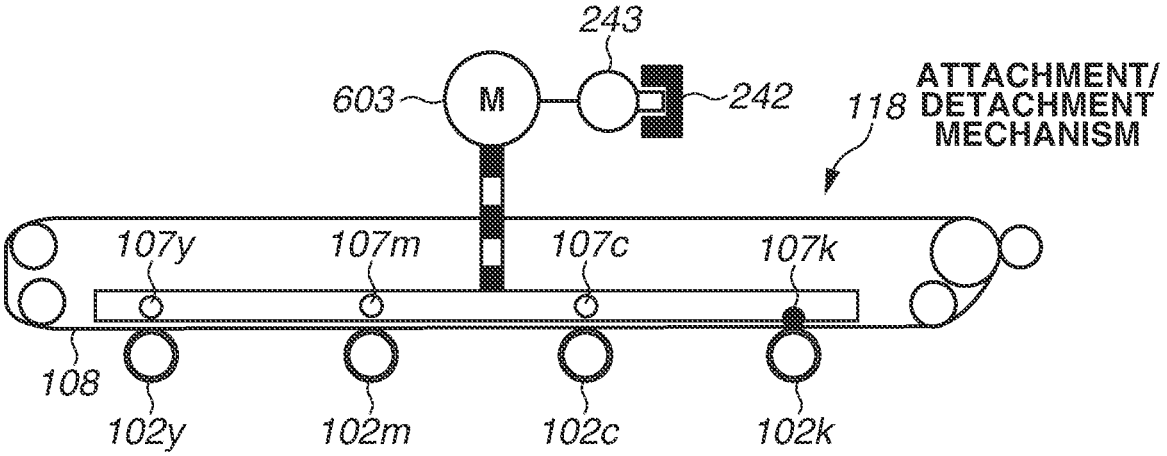
FIGS. 8A, 8B, and 8C are schematic diagrams each illustrating an attachment/detachment state between an intermediate transfer belt and photosensitive drums.

As illustrated in FIG. 8A, in a state where the home position detection sensor 242 detects the home position flag 243, the primary transfer roller 107*k* presses the intermediate transfer belt 108 against the photosensitive drum 102*k*, As a result, out of the photosensitive drums 102*y*, 102*m*, 102*c*, and 102*k*, only the photosensitive drum 102*k*, contacts the intermediate transfer belt 108. The state illustrated in FIG. 8A is referred to as the first contact state.

Figure 8B:
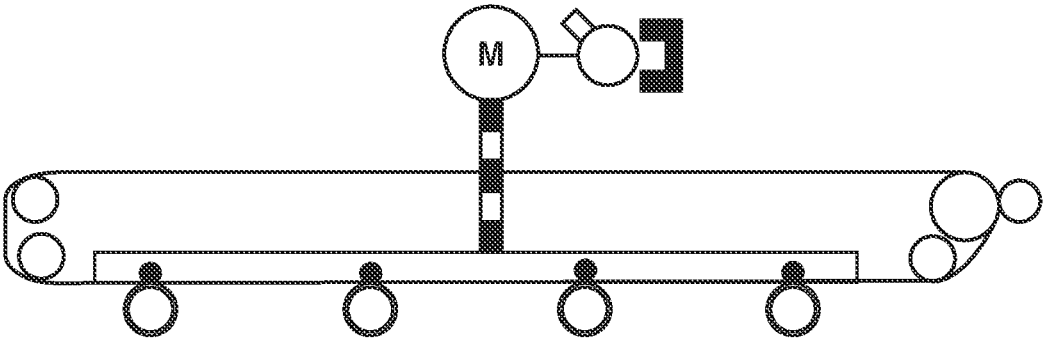

FIG. 8B illustrates a state where the attachment/detachment motor 603 is rotated by a first phase from the state where the home position detection sensor 242 detects the home position flag 243. In the state illustrated in FIG. 8B, the primary transfer rollers 107*y*, 107*m*, 107*c*, and 107*k* press the intermediate transfer belt 108 against the photosensitive drums 102*y*, 102*m*, 102*c*, and 102*k*, As a result, the photosensitive drums 102*y*, 102*m*, 102*c*, and 102*k* contact the intermediate transfer belt 108. The state illustrated in FIG. 8B is referred to as the second contact state.

Figure 8C:
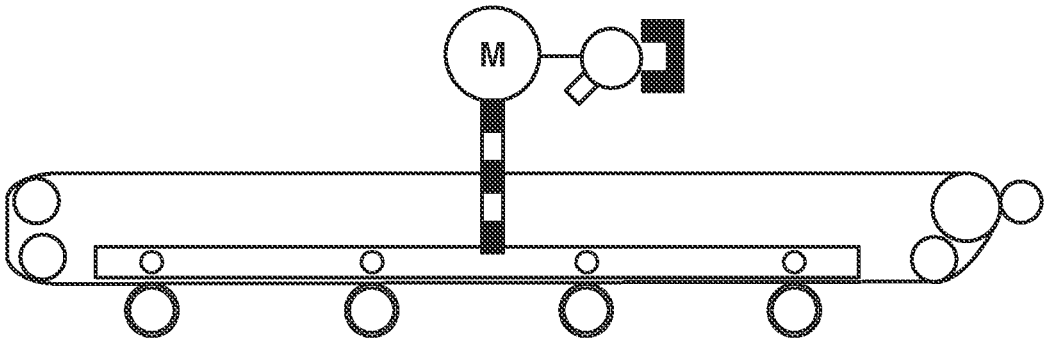

FIG. 8C illustrates a state where the attachment/detachment motor 603 is rotated by a second phase from the state where the home position detection sensor 242 detects the home position flag 243. In this case, the second phase is different from the first phase. In the state illustrated in FIG. 8C, the primary transfer rollers 107*y*, 107*m*, 107*c*, and 107*k* are separated from the intermediate transfer belt 108. As a result, the photosensitive drums 102*y*, 102*m*, 102*c*, and 102*k* are in a non-contact state in which the photosensitive drums 102*y*, 102*m*, 102*c*, and 102*k* are separated from the intermediate transfer belt 108. The state illustrated in FIG. 8C is referred to as the separation state.

At the time of starting-up, the image forming apparatus 1 controls the attachment/detachment motor 603 so that the attachment/detachment mechanism 118 shifts to the first contact state. At the time of starting an image formation operation, the image forming apparatus 1 executes the image formation while the first contact state is maintained in a case where a monochrome image is formed. On the other hand, in a case where a color image is formed, the image forming apparatus 1 executes the image formation operation after shifting to the second contact state. If the opened state of the right cover is detected by the opening/closing detection sensor 124, there is a possibility that the intermediate transfer belt 108 may be replaced, and therefore, the image forming apparatus 1 is controlled to enter the separation state.

In the case of executing a position control operation on the attachment/detachment mechanism 118, if an attachment/detachment control operation for the intermediate transfer belt 108 is not completed within a predetermined period, a central processing unit (CPU) 212*a* (FIG. 2) determines that an abnormality is detected in the attachment/detachment mechanism 118. The CPU 212' (FIG. 2) executes a failure diagnosis flow to identify a failure location so that the cause of the abnormality can be identified. The failure diagnosis flow will be described in detail below.

Figure 2:
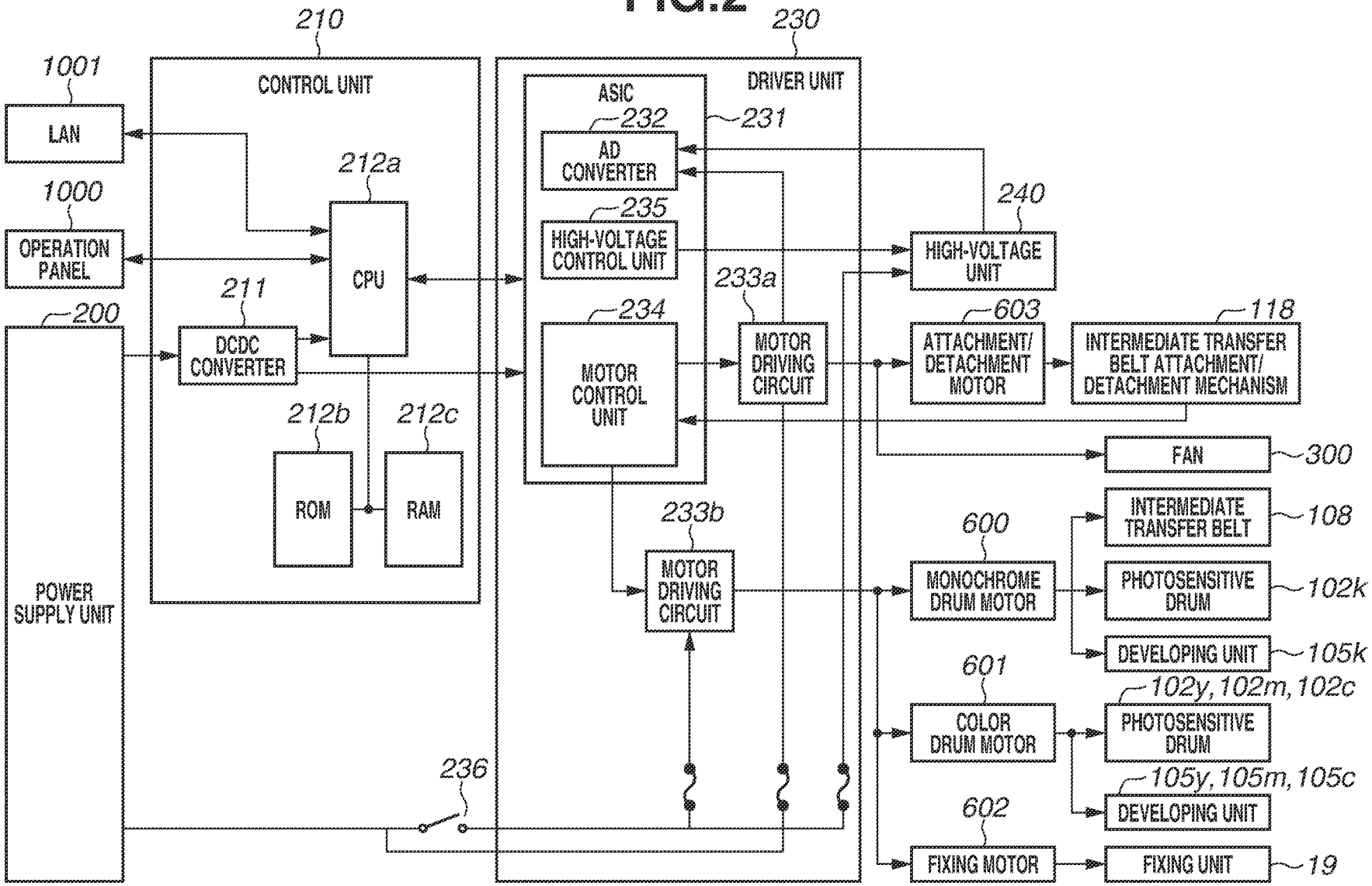
FIG. 2 is a control block diagram illustrating the image forming apparatus.

FIG. 2 is a control block diagram illustrating the image forming apparatus 1. The image forming apparatus 1 includes a power supply unit 200, a control unit 210, a driver unit 230, and a high-voltage unit 240. The control unit 210 includes an interface illustrated) that allows communication with the operation panel 1000 of the image forming apparatus 1 and a local area network (LAN) 1001 for connecting to a network.

The image forming apparatus 1 includes the control unit 210 that controls each unit of the image forming apparatus 1. The control a nit 210 includes the CPU 212*a*. The CPU 212*a* executes various control sequences for image formation based on programs stored in a read-only memory (ROM) 212*b*. The control unit 210 also includes a random access memory (RAM) 212*c* that functions as a system work memory. The CPU 212*a* is connected to an application specific integrated circuit (ASIC) 231, which is disposed on the driver unit 230, through serial communication, and executes a reading operation from a register or a RAM in the ASIC 231, and an operation of writing data into a register or a RAM in the ASIC 231. That is, the CPU 212*a* controls the ASIC 231.

Figure 3:
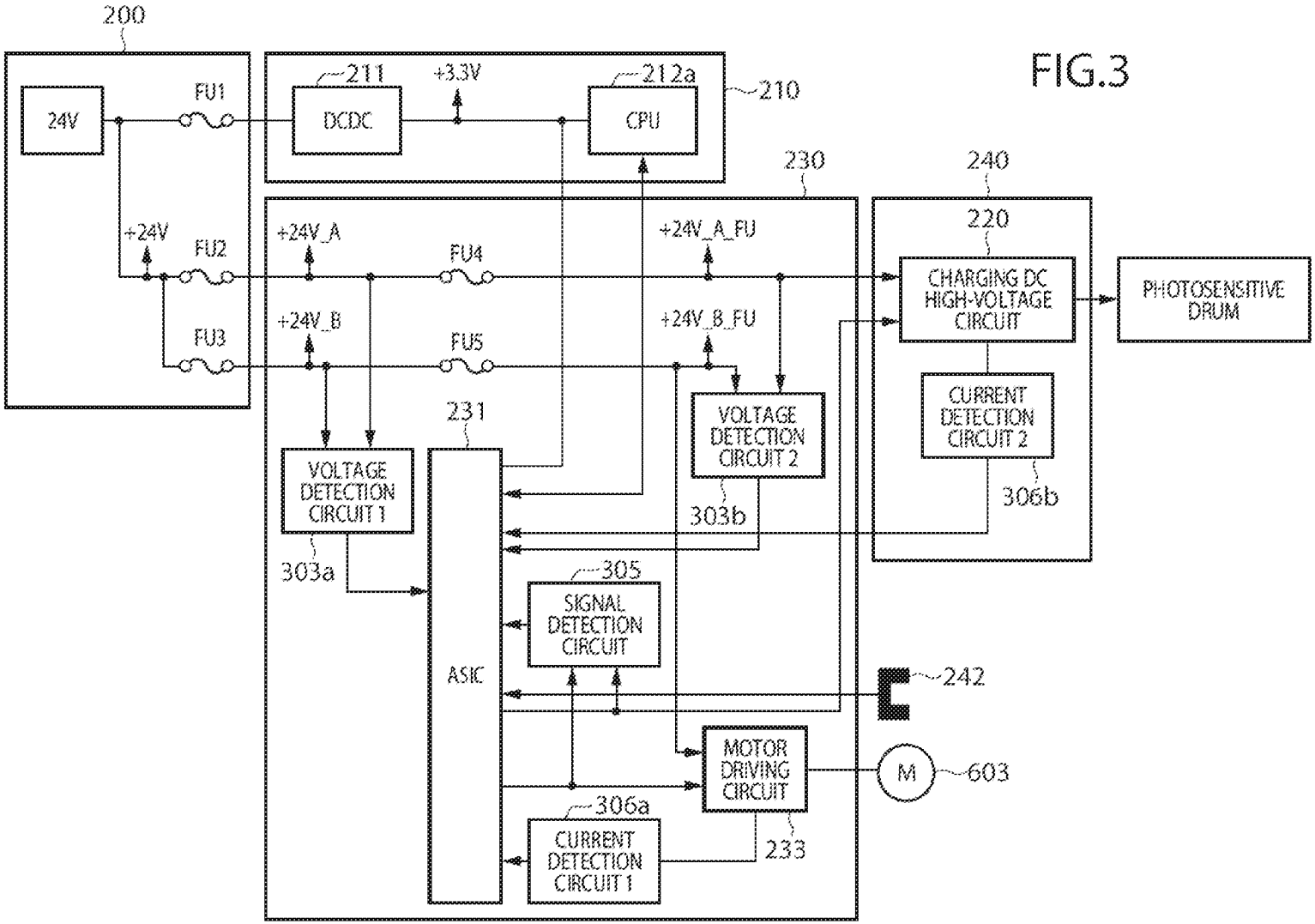
FIG. 3 an electric circuit diagram illustrating a major part of the image forming apparatus.

Next, a configuration of a power supply portion of the image forming apparatus 1 will be described. The power supply portion corresponds to the power supply unit 200. The power supply unit 200 supplies power of +24 V to each substrate through a fuse FU1, a fuse FU2, and a fuse FU3 (FIG. 3). The control unit 210 includes a direct current (DCDC) converter 211 that converts the supplied power supply voltage of +24 V into +3.3 V. The voltage of +3.3 V, which is obtained through conversion by the DCDC converter 211, is supplied to the CPU 212*a* and the driver unit 230. The voltage of +3.3 V, which is obtained through conversion by the DCDC converter 211, is also supplied to the ASIC 231.

The power supply voltage of +24 V fed to the driver unit 230 from the power supply unit 200 is further fed to the high-voltage unit 240 and a motor driving circuit 233 through a fuse FU4 and a fuse FU5 (FIG. 3) of the driver unit 230. The power supply voltage of +24 V is divided into a power supply system in which the power supply is turned on/off by an interlock switch 236 that interrupts the power supply in conjunction with the opening/closing operation of the front cover or the right cover, and a power supply system in which power is supplied regardless of the above-described opening/closing state. The attachment/detachment motor 603 and the fan 300 belong to the power supply system in which power is supplied regardless of the above-described opening/closing state.

A signal output portion of the image forming apparatus 1 will be described. The signal output portion corresponds to the ASIC 231. An analog-to-digital (AD) converter 232, a motor control unit 234, and a high-voltage control unit 235, which are illustrated in FIG. 2, are functional modules of the ASIC 231. The high-voltage control unit 235 is implemented by a logic circuit for controlling the high-voltage unit 240. The motor control unit 234 is implemented by a logic circuit for controlling a monochrome drum motor 600, a color drum motor 601, a fixing motor 602, the attachment/detachment motor 603, and the fan 300. The fan 300 includes a motor (not illustrated) for driving the fan 300. The ASIC 231 functions as the above-described functional module based on a control signal input through serial communication from the CPU 212*a*. As a result, the control signal from the CPU 212*a* controls the ASIC 231.

A control circuit portion of the image forming apparatus 1 will be described. The control circuit portion varies depending on an object to be diagnosed. In failure diagnosis for a charging DC high-voltage circuit to be described below, the control circuit portion corresponds to the high-voltage unit 240. In failure diagnosis for an intermediate transfer belt attachment/detachment function to be described below, the control circuit portion corresponds to a motor driving circuit 233*a*. A motor driving circuit 233*b* corresponds to the control circuit portion for controlling the monochrome drum motor 600, the color drum motor 601, and the fixing motor 602.

The control circuit portion operates based on a power supplied from the power supply portion and an output signal from the signal output portion. For example, the motor driving circuits 233*a* and 233*b* include a driver IC for driving a motor. When a control signal for rotating the motor is input, the driver IC controls the rotation of the motor. When the motor is rotated, the photosensitive drum 102, the intermediate transfer belt 108, the developing unit 105, the fixing unit 19, the attachment/detachment mechanism 118, and the fan 300 are driven.

A detection signal from the home position detection sensor 242, which is provided in the attachment/detachment mechanism 118, is input to the ASIC 231. In this case, the detection signal from the home position detection sensor 242 is used to determine the contact state or the separation state of the intermediate transfer belt 108. The detection signal input to the ASIC 231 is transferred to the CPU 212*a*. The CPU 212*a* executes the position control operation on the attachment/detachment mechanism 118 based on the transferred detection signal.

(Failure Diagnosis)

Figure 5:
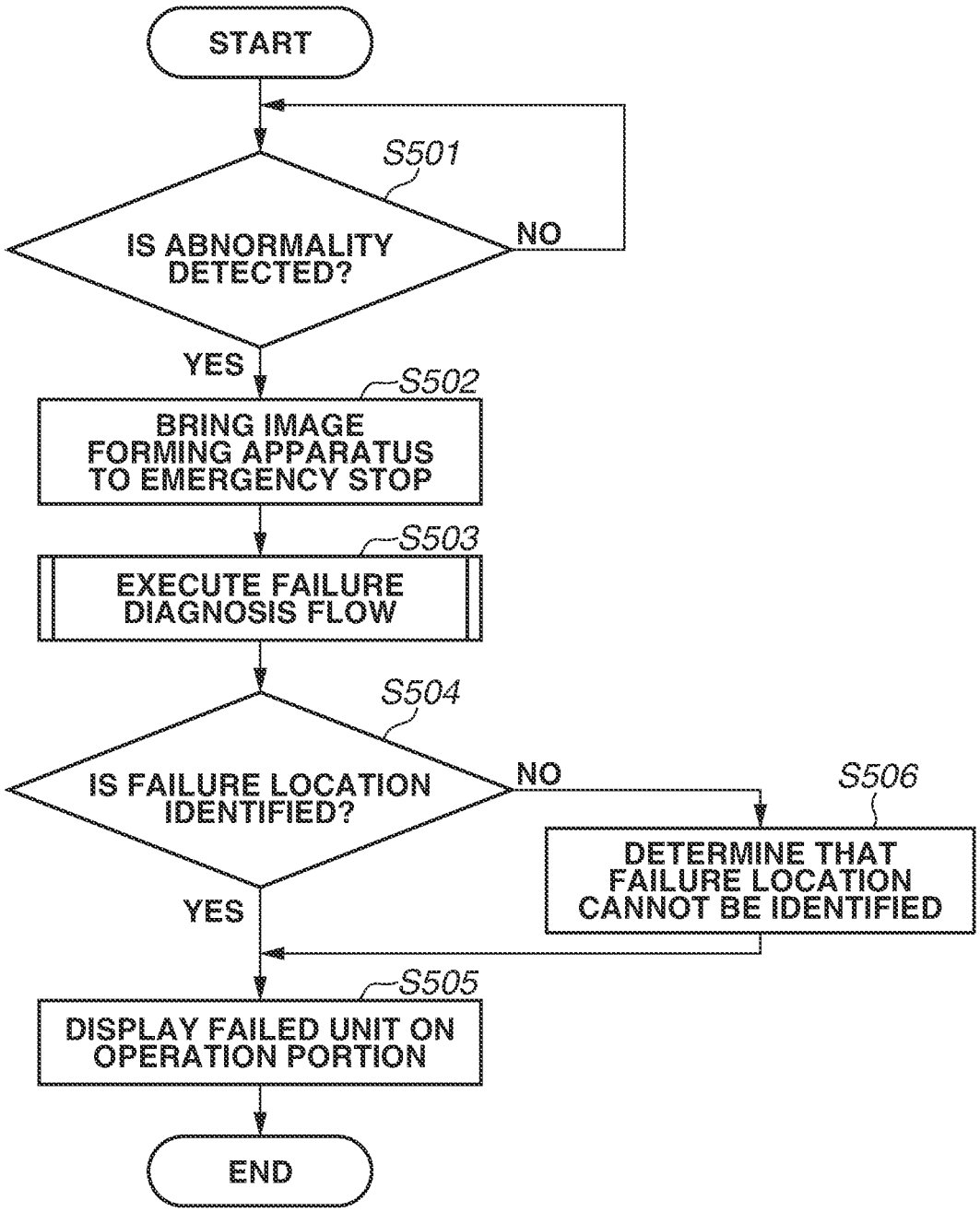
FIG. 5 is a flowchart illustrating failure diagnosis processing.

Next, failure diagnosis to be executed by the CPU 212*a* of the image forming apparatus 1 will be described with reference to a flowchart illustrated in FIG. 5.

The term "failure" used herein refers to a state where the function cannot be normally executed and a repair or replacement operation is required. The term "abnormality" used herein refers to a state where a sequence is not normally executed before the "failure" occurs. Even if the "abnormality" has occurred, the image forming apparatus 1 does not necessarily requires an immediate repair or replacement operation. Even in the case where the "abnormality" has occurred in the image forming apparatus 1, the "abnormality" may disappear after the sequence is executed again.

When a main power supply of the image forming apparatus 1 is turned on, the CPU 212*a* reads out a failure diagnosis program from the ROM 212*b* and executes the failure diagnosis program. Control steps to be described below are executed by the CPU 212*a*.

Figure 14:
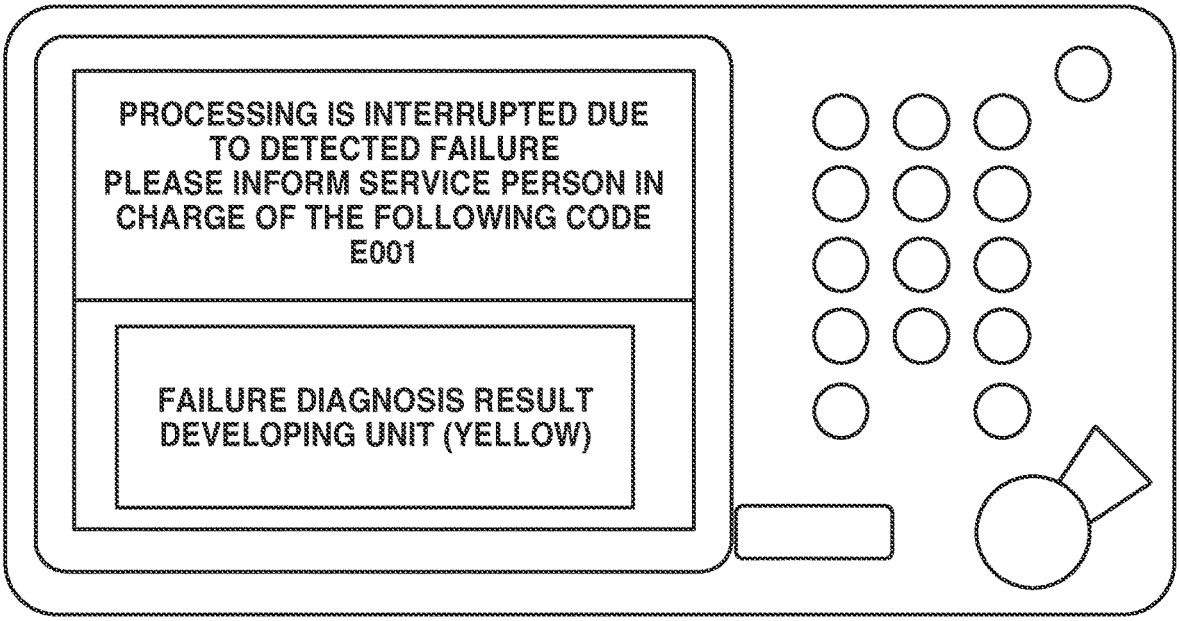
FIG. 14 illustrates a display example of the screen to be displayed on the operation panel.

First, in step S501, the CPU 212*a* determines whether the abnormality has been detected based on a detection signal from the sensors included in the image forming apparatus 1, or an output signal from the motor. The CPU 212*a* functions as an abnormality detection unit that detects the abnormality in the image forming apparatus 1. If the abnormality is detected in step S501 (YES in step S501), the processing proceeds to step S502. In step S502, the CPU 212*a* interrupts the operation of the image forming apparatus 1. In step S503, the CPU 212*a* executes the failure diagnosis flow for identifying a failure location. In step S504, the CPU 212*a* determines whether the failure location is identified in the failure diagnosis flow. If the failure location is identified (YES in step S504), the processing proceeds to step S505. In step S505, the CPU 212*a* displays a screen for notifying the failure location on the display of the operation panel 1000. FIG. 14 illustrates an example of the screen for notifying the failure location. After the screen for notifying the failure location is displayed on the display in step S505, the CPU 212*a* terminates the failure diagnosis processing.

Figure 15:
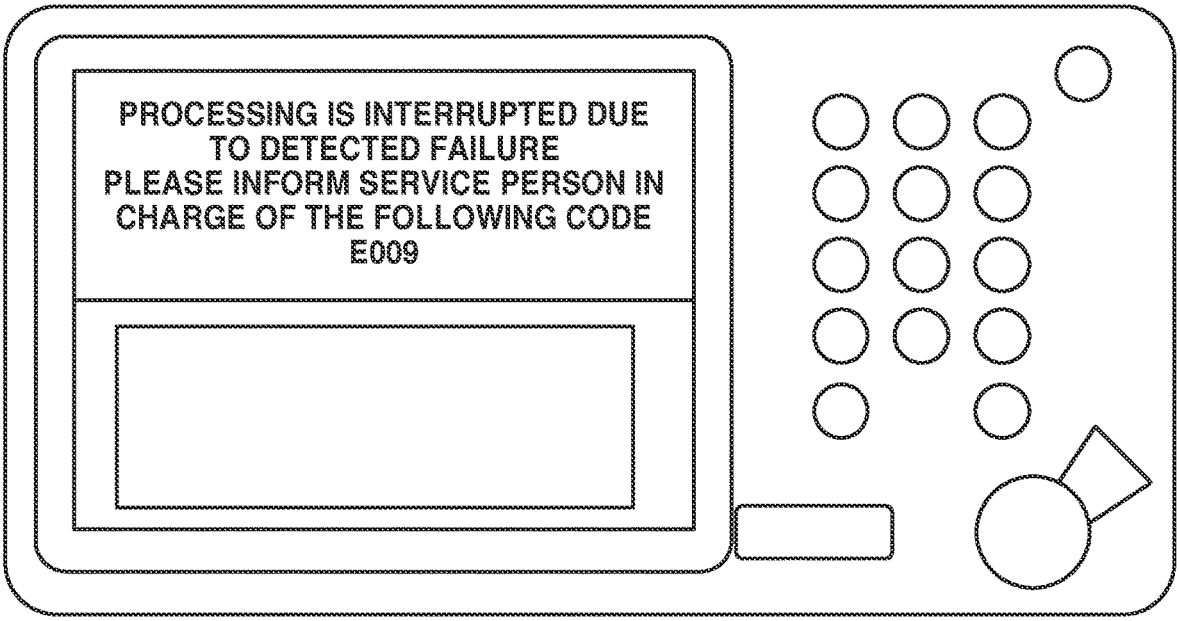
FIG. 15 illustrates a display example of the screen to be displayed on the operation panel.

On the other hand, if the failure location cannot be identified in step S504 (NO in step S504), the processing proceeds to step S506. In step S506, the CPU 212*a* produces a screen for notifying the occurrence of the failure without identifying the failure location on the display of the operation panel 1000. FIG. 15 illustrates an example of the screen for notifying the occurrence of the failure without identifying the failure location. After the screen for notifying the occurrence of the failure is produced on the display in step S506, the CPU 212*a* terminates the failure diagnosis processing.

(Electric Failure Diagnosis for Attachment/Detachment Motor)

Figure 6:
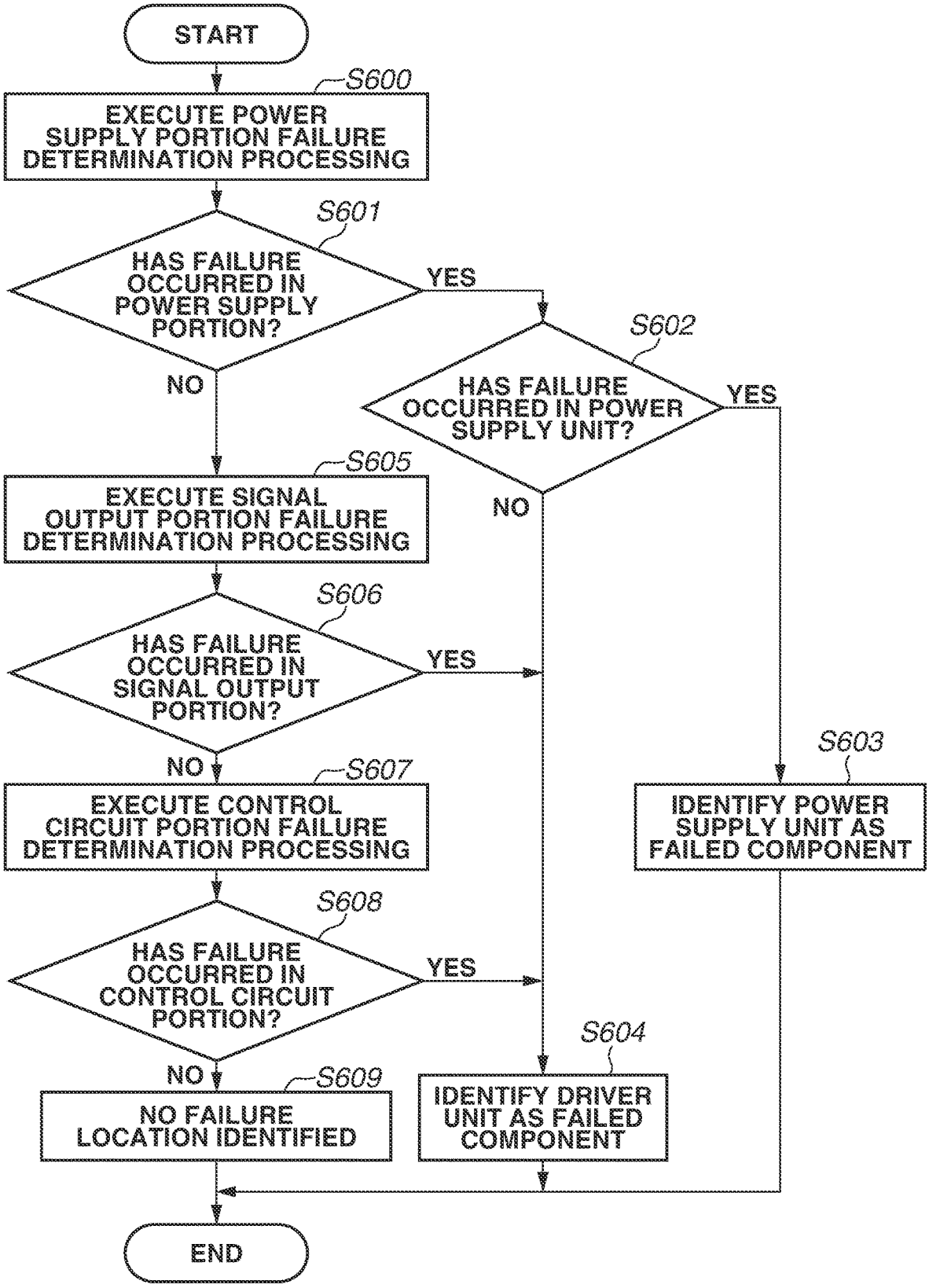
FIG. 6 is a flowchart illustrating electric failure diagnosis processing for an attachment/detachment mechanism.

Next, electric failure diagnosis for the attachment/detachment motor 603 will be described with reference to FIGS. 3, 4, and 6. FIG. 3 is a diagram illustrating a major part of an electric circuit in the image forming apparatus 1. In this case, the power supply unit 200 includes the fuses FU1, FU2, and FU3, and the driver unit 230 includes the fuses FU4 and FU5. The fuses FU1, FU2, FU3, FU4, and FU5 are provided to protect against a flow of overcurrent. FIG. 4 is an electric failure diagnosis table illustrating a relationship among a power supply for operating a diagnosis target electric component (a motor or a high-voltage output circuit), a control signal, a control circuit, and an operating load. FIG. 6 is a flowchart illustrating electric failure diagnosis processing for the attachment/detachment motor 603.

If the home position detection sensor 242 cannot detect the home position flag 243 after a lapse of a predetermined period from a time that an instruction to start the rotation of the attachment/detachment motor 603 is made, the CPU 212*a* executes the electric failure diagnosis for the attachment/detachment motor 603. In the case of executing the electric failure diagnosis for the attachment/detachment motor 603, in step S600, the CPU 212*a* executes the failure diagnosis on the power supply portion. As illustrated in the table of FIG. 4, the failure diagnosis on the power supply portion is determined based on a voltage value of +24 V_B_FU. In step S601, the CPU 212*a* determines whether a failure has occurred in the power supply portion based on whether the voltage value of +24 V_B_FU detected by a voltage detection circuit 303*b* is more than or equal to a threshold. In step S601, the threshold is, for example, 18 V.

In step S601, if the voltage value detected by the voltage detection circuit 303*b* is less than 18 V, the CPU 212*a* determines that a failure has occurred in the power supply portion. The CPU 212*a* functions as the abnormality detection unit that detects an abnormality in the image forming apparatus 1. In step S601, if the voltage value detected by the voltage detection circuit 303*b* is less than 18 V (NO in step S601), the processing proceeds to step S602. In step S602, the CPU 212*a* determines whether a failure has occurred in the power supply unit 200. In step S602, the CPU 212*a* determines whether a failure has occurred in the power supply unit 200 based on whether a voltage value of +24 V_B detected by a voltage detection circuit 303*a* of the driver unit 230 is more than or equal to a predetermined value. In step S602, the predetermined value is, for example, 18 V. The predetermined value may be a value that is different from the threshold.

In step S602, if the voltage value detected by the voltage detection circuit 303*a* is less than 18 V, the CPU 212*a* determines whether a failure has occurred in the power supply unit 200. In this case, in step S603, the CPU 212*a* identifies the power supply unit 200 as a failed component. Then, the CPU 212*a* terminates the electric failure diagnosis processing for the attachment/detachment motor 603.

On the other hand, in step S602, if the voltage value detected by the voltage detection circuit 303*a* is more than or equal to 18 V, the CPU 212*a* determines that no failure has occurred in the power supply unit 200. In this case, in step S604, the CPU 212*a* identifies the driver unit 230 as a failed component. Then, the CPU 212*a* terminates the electric failure diagnosis processing for the attachment/detachment motor 603.

In step S601, if the voltage value detected by the voltage detection circuit 303*b* is more than or equal to 18 V, the CPU 212*a* determines that no failure has occurred in the power supply portion. In step S601, if it is determined that no failure has occurred in the power supply portion (NO in step S601), the processing proceeds to step S605 to perform failure determination processing for the signal output portion. In step S606, the CPU 212*a* determines whether the failure has occurred in the signal output portion based on a motor control signal input to the motor driving circuit 233*a* from the ASIC 231 and a voltage value detected by a signal detection circuit 305. In this case, the motor control signal includes signals representing a motor rotation direction, a motor speed, and a motor drive mode. In step S606, for example, if the voltage value detected by the signal detection circuit 305 is more than or equal to 2.8 V in a state where the ASIC 231 controls the motor control signal to be at a high level, the CPU 212*a* determines that no failure has occurred in the signal output portion.

Instead, in step S606, the CPU 212*a* may determine that no failure has occurred in the signal output portion, if the voltage value detected by the signal detection circuit 305 is less than or equal to 2.8 V in a state where the ASIC 231 controls the motor control signal to be at a low level.

In step S606, if the failure has occurred in the signal output portion (YES in step S606), the processing returns to step S604. Specifically, if the voltage value detected by the signal detection circuit 305 is less than 2.8 V in the state where the ASIC 231 controls the motor control signal to be at the high level, the CPU 212*a* determines that the failure has occurred in the signal output portion, and the processing returns to step S604. If the voltage value detected by the signal detection circuit 305 is more than 2.8 V in the state where the ASIC 231 controls the motor control signal to be at the low level, the CPU 212*a* determines that the failure has occurred in the signal output portion, and then the processing returns to step S604.

In step S606, if no failure has occurred in the signal output portion (NO in step S606), the processing proceeds step S607 to perform failure determination processing for the control circuit portion. In step S608, the CPU 212*a* determines whether a failure has occurred in the control circuit portion based on a current value detected by a current detection circuit 306*a* in a state where the motor driving circuit 233 drives the attachment/detachment motor 603. In step S608, if the value of a current flowing to the attachment/detachment motor 603 from the motor driving circuit 233 is less than a predetermined current value in a state where the power and signal are input to the motor driving circuit 233, the CPU 212*a* determines that a failure has occurred in the control circuit portion. The motor driving circuit 233 is mounted on the driver unit 230. Accordingly, if the failure has occurred in the control circuit portion, the driver unit 230 needs to be repaired or replaced. That is, if the current value detected by the current detection circuit 306*a* is less than the predetermined current value (YES in step S608), the processing returns to step S604. Assume herein that the predetermined current value is 100 mA.

On the other hand, in step S608, if the current value detected by the current detection circuit 306*a* is more than or equal to the predetermined current value (NO in step S608), the processing proceeds to step S609. In step S609, the CPU 212*a* determines that no failure has occurred in the control circuit portion and there is no failure location, and then terminates the electric failure diagnosis processing for the attachment/detachment motor 603.

(Electric Failure Diagnosis for Charging DC High-Voltage Output)

Figure 7:
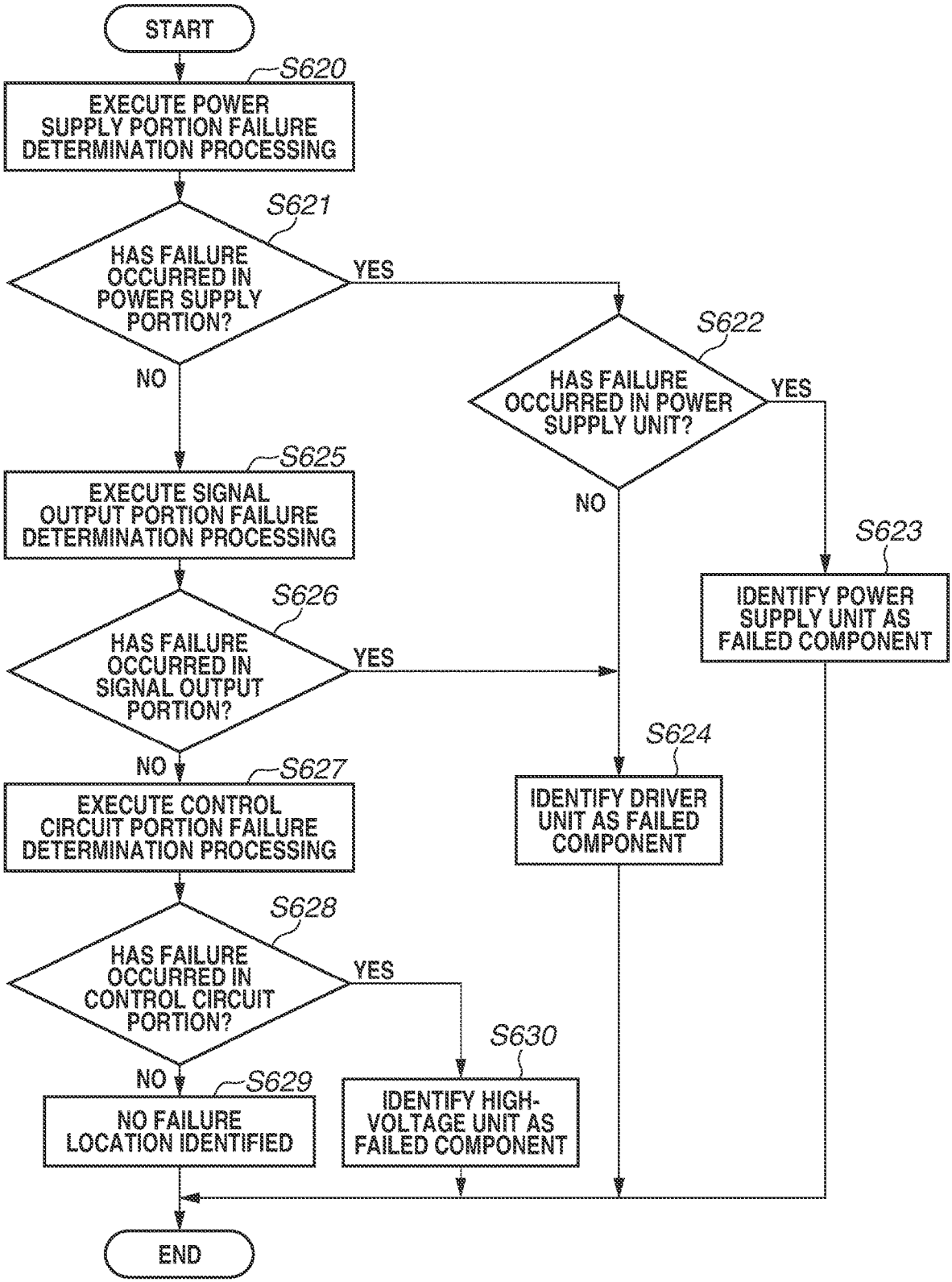
FIG. 7 is a flowchart illustrating electric failure diagnosis processing for a charging direct current (DC) high-voltage circuit.

Next, electric failure diagnosis processing for a charging DC high-voltage circuit 220 will be described with reference to FIGS. 3, 4, and 7. FIG. 7 is a flowchart illustrating the electric failure diagnosis processing for the charging DC high-voltage circuit 220. For example, even in a case where the high-voltage unit 240 applies a voltage to the charging roller 103, if the value of a current flowing to the charging roller 103 falls within a predetermined range, the CPU 212*a* executes the electric failure diagnosis processing for the charging DC high-voltage circuit 220.

In step S620, the CPU 212*a* first executes the failure diagnosis processing for the power supply portion. The determination in the failure diagnosis processing for the power supply portion in step S620 is made based on a voltage value of +24 V_A_FU as illustrated in the table of FIG. 4. In step S621, the CPU 212*a* determines whether a failure has occurred in the power supply portion based on whether the voltage value of +24 V_A_FU detected by the voltage detection circuit 303*b* is more than or equal to a threshold, in step S621, the threshold is, for example, 18 V.

In step S621, if the voltage value detected by the voltage detection circuit 303*b* is less than 18 V, the CPU 212*a* determines that the failure has occurred in the power supply portion. In step S621, if the voltage value detected by the voltage detection circuit 303*b* is less than 18 V (YES in step S621), the processing proceeds to step S622. In step S622, the CPU 212*a* determines whether the failure has occurred in the power supply unit 200. In step S622, the CPU 212*a* determines whether the failure has occurred in the power supply unit 200 based on whether a voltage value of +24 V_A detected by the voltage detection circuit 303*a* of the driver unit 230 is more than or equal to a predetermined value. In step S622, the predetermined value is, for example, 18 V. The predetermined value may be a value that is different from the threshold.

In step S622, the voltage value detected by the voltage detection circuit 303*a* is less than 18 V, the CPU 212*a* determines that a failure has occurred in the power supply unit 200. In this case, in step S623, the CPU 212*a* identifies the power supply unit 200 as a failed component. Then, the CPU 212*a* terminates the electric failure diagnosis processing for the charging DC high-voltage circuit 220.

On the other hand, in step S622, if the voltage value detected by the voltage detection circuit 303*a* is more than or equal to 18 V, the CPU 212*a* determines that no failure has occurred in the power supply unit 200. In this case, in step S624, the CPU 212*a* identifies the driver unit 230 as a failed component. Then, the CPU 212*a* terminates the electric failure diagnosis processing for the charging DC high-voltage circuit 220.

In step S621, if the voltage value detected by the voltage detection circuit 303*b* is more than or equal to 18 V, the CPU 212*a* determines that no failure has occurred in the power supply portion. In step S621, if it is determined that no failure has occurred in the power supply portion (NO in step S621), the processing proceeds to step S625 to perform the failure determination processing for the signal output portion. In step S626, the CPU 212*a* determines whether a failure has occurred in the signal output portion based on a high-voltage control signal input to the charging DC high-voltage circuit 220 from the ASIC 231 and a voltage value detected by the signal detection circuit 305. In this case, the high-voltage control signal includes an output voltage setting signal and a transformer driving clock signal. In step S626, for example, if the voltage value detected by the signal detection circuit 305 in a state where the ASIC 231 controls the high-voltage control signal to be at the high level is more than or equal to 2.8 V, the CPU 212*a* determines that no failure has occurred in the signal output portion.

Alternatively, in step S626, if the voltage value detected by the signal detection circuit 305 in a state where the ASIC 231 controls the high-voltage control signal to be at the low level is less than or equal to 2.8 V, the CPU 212*a* may determine that no failure has occurred in the signal output portion.

In step S626, if it is determined that the failure has occurred in the signal output portion (YES in step S626), the processing returns to step S624, Specifically, if the voltage value detected by the signal detection circuit 305 is less than 2.8 V in the state where the ASIC 231 controls the high-voltage control signal to be at the high level, the CPU 212*a* determines that the failure has occurred in the signal output portion, and then the processing returns to step S624. If the voltage value detected by the signal detection circuit 305 is more than 2.8 V in the state where the ASIC 231 controls the high-voltage control signal to be at the low level, the CPU 212*a* determines that the failure has occurred in the signal output portion, and then the processing returns to step S624.

In step S626, if it is determined that no failure has occurred in the signal output portion (NO in step S626), the processing proceeds to step S627 to perform the failure determination processing for the control circuit portion. In step S628, the CPU 212*a* determines whether a failure has occurred in the control circuit portion based on a current value detected by a current detection circuit 306*b* in a state where an output from the charging DC high-voltage circuit 220 is controlled to be at −1000 V. In step S628, if the value of a current flowing to the charging DC high-voltage circuit 220 is less than a predetermined current value in a state where the power and signal are input to the charging DC high-voltage circuit 220, the CPU 212*a* determines that the failure has occurred in the control circuit portion. The charging DC high-voltage circuit 220 is mounted on the high-voltage unit 240. Accordingly, if the failure has occurred in the control circuit portion, the high-voltage unit 240 needs to be repaired or replaced. Specifically, if the current value detected by the current detection circuit 306*b* is less than the predetermined current value (YES in step S628), the processing proceeds to step S630. In step S630, the CPU 212*a* identifies the high-voltage unit 240 as a failed component. Assume herein that the predetermined current value is 20 μA. Then, the CPU 212*a* terminates the electric failure diagnosis processing for the charging DC high-voltage circuit 220.

In step S628, if the current value detected by the current detection circuit 306*b* is more than or equal to the predetermined current value (NO in step S628), the processing proceeds to step S629. In step S629, the CPU 212*a* determines that no failure has occurred in the control circuit portion and that there is no failure location. Then, the CPU 212*a* terminates the electric failure diagnosis processing for the charging DC high-voltage circuit 220. In the failure diagnosis processing for the charging DC high-voltage circuit 220, the failure location is identified without operating the load.

Like in the failure diagnosis processing for the charging DC high-voltage circuit 220, in failure diagnosis processing for a high-voltage circuit (not illustrated) that applies a voltage to be supplied to each of the developing unit 105, the primary transfer roller 107, and the secondary transfer roller 15, failure diagnosis processing for the power supply portion, failure diagnosis processing for the signal output portion, and failure diagnosis processing for the control circuit portion are executed in this order. In this case, the signal detection circuit 305, the current detection circuit 306*a*, and the current detection circuit 306*b* may be provided for each high-voltage circuit.

(Failure Diagnosis Type)

Next, failure diagnosis flow types will be described. The failure diagnosis processing includes two types of failure diagnosis processing. That is, a first failure diagnosis type in which failure diagnosis processing is executed even in a state where the print sheet S remains in the image forming portion 3, and a second failure diagnosis type in which failure diagnosis processing is not executed in the state where the print sheet S remains in the image forming portion 3. The failure diagnosis processing of the second failure diagnosis type refers to processing in which, for example, the print sheet S remaining in the image forming portion 3 may be damaged when the failure diagnosis processing is executed. Specific examples will be described below.

Figure 9:
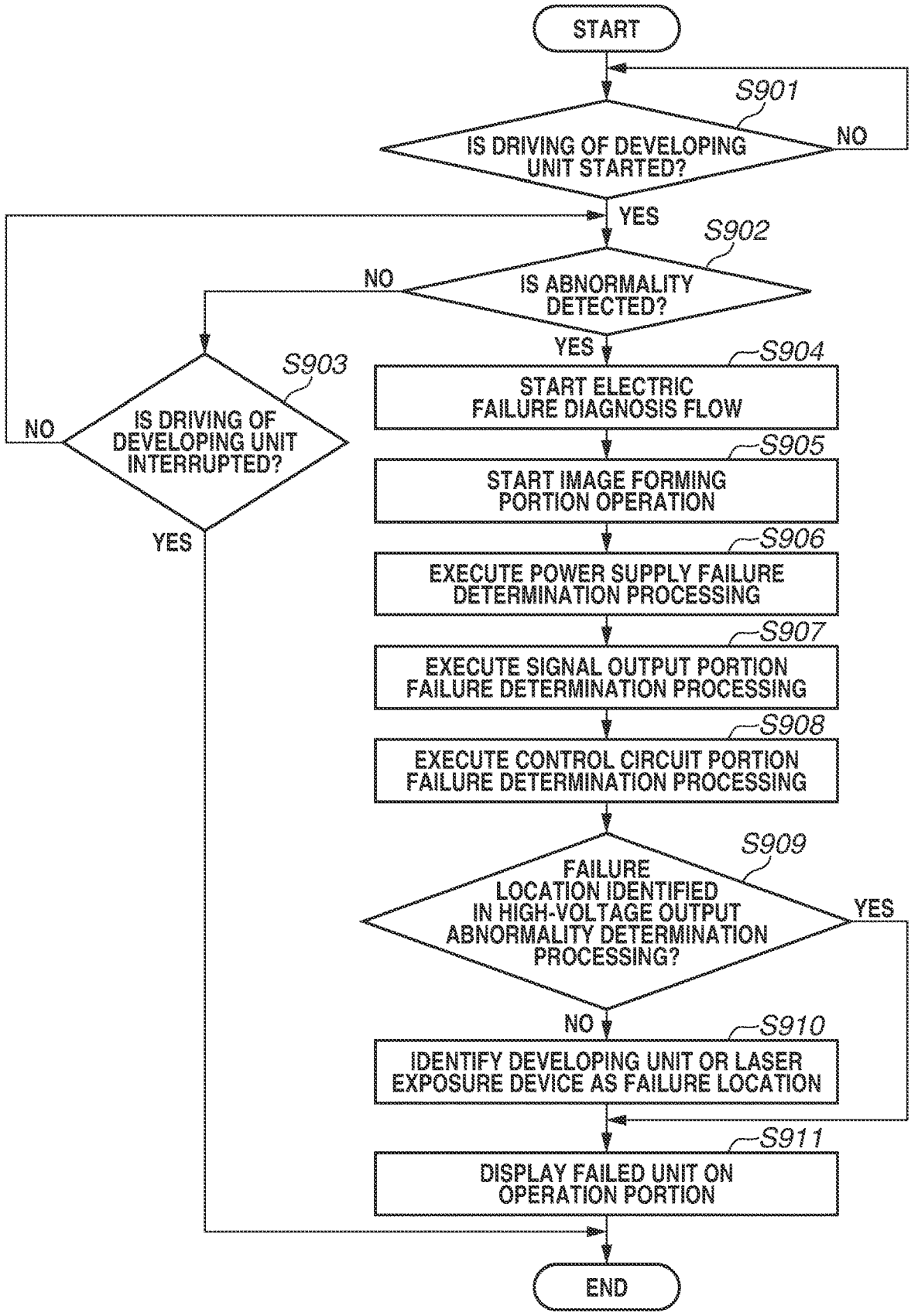
FIG. 9 is a flowchart illustrating failure diagnosis processing for a developing unit.

As an example of the first failure diagnosis type, failure diagnosis processing for the developing unit 105 will be described with reference to a flowchart illustrated in FIG. 9. After driving of the developing unit 105 is started in step S901 (YES in step S901), the processing proceeds to step S902. In step S902, the CPU 212*a* determines whether an abnormality is detected in the developing unit 105. In step S902, the CPU 212*a* detects the abnormality in the developing unit 105 based on an output value from an inductance sensor (not illustrated) provided in the developing unit 105. For example, if output values output from the inductance sensor which are detected at an every predetermined time, continuously fall outside the predetermined range, the CPU 212*a* detects the abnormality in the developing unit 105.

In step S902, if no abnormality is detected (NO in step S902), the processing proceeds to step S903. In step S903, the CPU 212*a* determines whether driving of the developing unit 105 is normally interrupted at an appropriate timing. For example, during a predetermined period in an initial operation of the developing unit 105, the developing unit 105 is driven and then driving of the developing unit 105 is interrupted. If toner images are continuously formed on a plurality of print sheets, driving of the developing unit 105 is interrupted after a predetermined period has elapsed from when the toner images are formed on the last print sheet. The CPU 212*a* continuously drives the developing unit 105 until an abnormality is detected in the developing unit 105, or until driving of the developing unit 105 is normally ended.

If the abnormality is detected in the developing unit 105 in step S902 (YES in step S902), the processing proceeds to step S904. After temporarily interrupting driving of the developing unit 105, in step S904, the CPU 212*a* starts execution of the electric failure diagnosis processing (FIG. 7) for the charging DC high-voltage circuit 220. In a case where the electric failure diagnosis processing (FIG. 7) for the charging DC high-voltage circuit 220 is started, in step S905, the CPU 212*a* performs control such that the image forming portion 3 is brought into a state where the charging DC high-voltage circuit 220 can apply a high voltage.

Next, the CPU 212*a* executes failure diagnosis for the power supply portion in step S906, failure diagnosis for the signal output portion in step S907, and failure diagnosis for the control circuit portion in step S908, and then identifies a failure location. The failure diagnosis processing has been described in detail above with reference to FIG. 7, and thus the description thereof is omitted. In step S909, the CPU 212*a* determines whether the failure location is identified in the electric failure diagnosis processing for the charging DC high-voltage circuit 220. In step S909, if the failure location cannot be identified (NO in step S909), the processing proceeds to step S910. In step S910, the CPU 212*a* identifies the developing unit 105 or the laser exposure device 104 as the failure location. In step S911, the CPU 212*a* displays a screen for notifying the identified failure location on the display of the operation panel 1000, and then terminates the failure diagnosis processing.

On the other hand, in step S909, if the failure location is identified (YES in step S909), the processing proceeds to step S909. In step S911, the CPU 212*a* displays a screen for notifying the failure location identified in step S909 on the display of the operation panel 1000, and then terminates the failure diagnosis processing.

In the failure diagnosis processing for the developing unit 105, there is no possibility of damaging the print sheet S remaining in the conveyance path. Accordingly, the failure diagnosis processing can be executed even in the state where the print sheet S remains in the image forming portion 3. That is, the failure diagnosis processing for the developing unit 105 belongs to the first failure diagnosis type.

Figure 10:
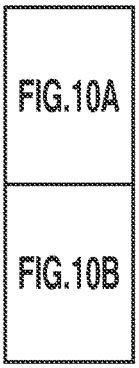
FIG. 10 is a flowchart illustrating in FIGS. 10A and 10B failure diagnosis processing for the attachment/detachment mechanism.
Figure 10A:
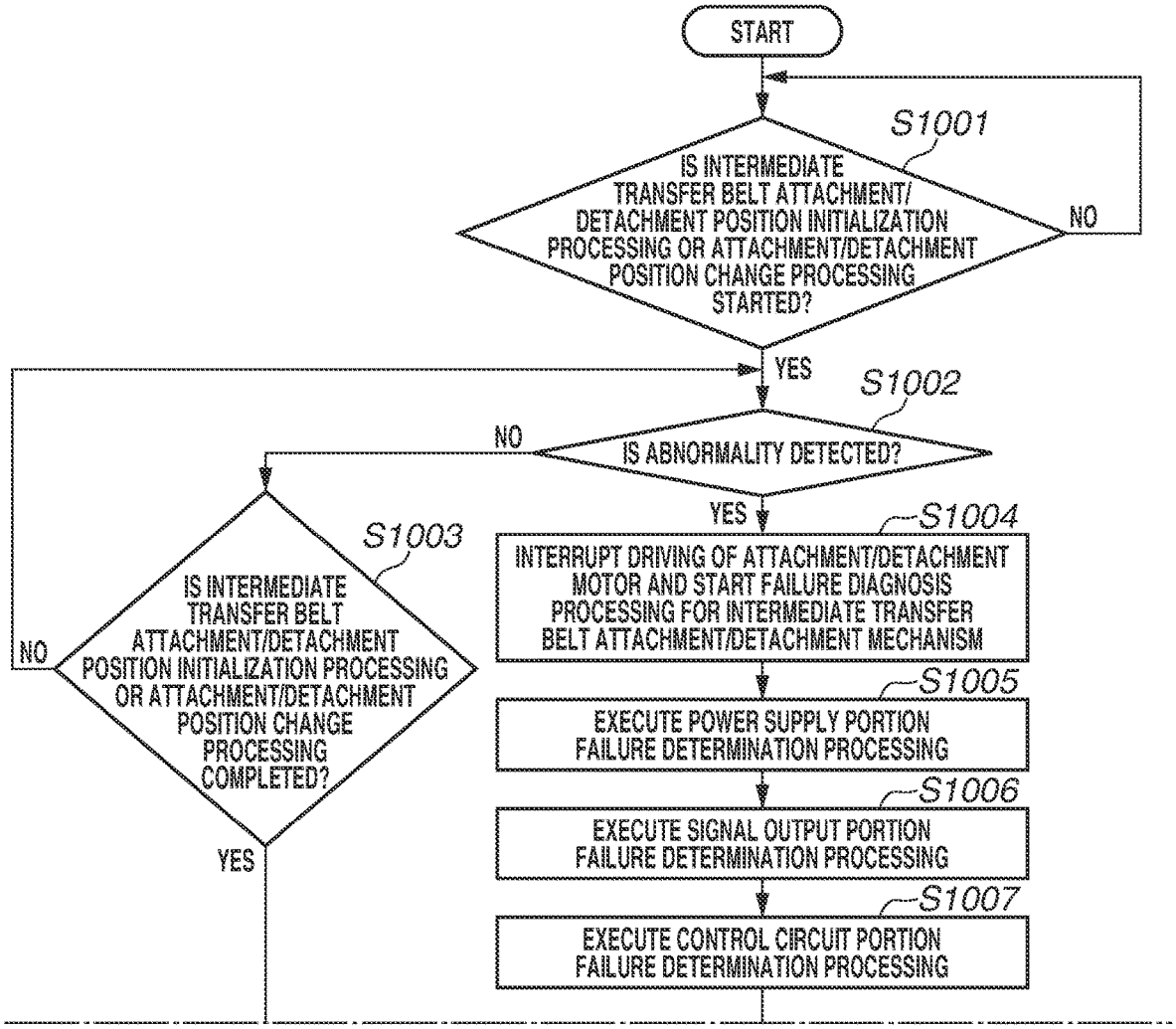
Figure 10B:
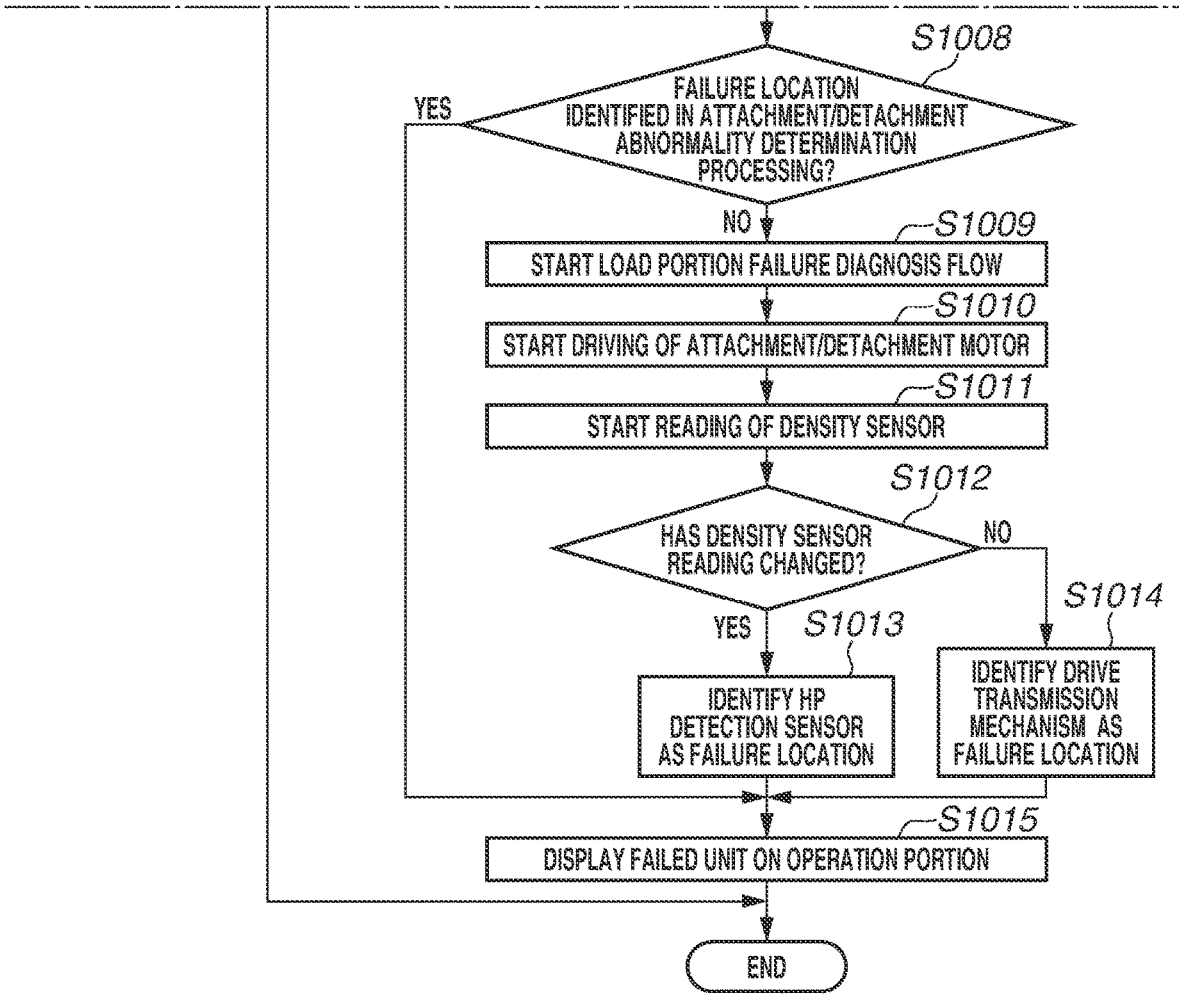

As an example of the second failure diagnosis type, failure diagnosis processing for the attachment/detachment mechanism 118 will be described with reference to a flowchart illustrated in FIG. 10 (FIGS. 10A and 10B) and schematic diagrams illustrated in FIGS. 8A to 8C.

In step S1001, the CPU 212*a* waits until an initialization operation for the attachment/detachment mechanism 118 or an attachment/detachment position change operation is executed. When the initialization operation for the attachment/detachment mechanism 118 or the attachment/detachment position change operation is executed (YES in step S1001), the processing proceeds to step S1002. In step S1002, the CPU 212*a* determines whether an abnormality is detected in the attachment/detachment mechanism 118. In step S1002, if the home position detection sensor 242 cannot detect the home position flag 243 even after a lapse of a predetermined period from a time when the rotation of the attachment/detachment motor 603 is started, the CPU 212*a* detects the abnormality in the attachment/detachment mechanism 118.

In step S1002, if no abnormality is detected (NO in step S1002), the processing proceeds to step S1003. In step S1003, the CPU 212*a* determines whether the initialization operation for the attachment/detachment mechanism 118 or the attachment/detachment position change operation is normally ended. In step S1003, for example, if a time required for the attachment/detachment mechanism 118 to move to any attachment/detachment position after the rotation of the attachment/detachment motor 603 is started, has elapsed, the CPU 212*a* determines that the initialization operation or the attachment/detachment position change operation is normally ended. The CPU 212*a* continuously drives the developing unit 105 until an abnormality is detected in the attachment/detachment mechanism 118, or until the initialization operation or the attachment/detachment position change operation is normally ended.

In step S1002, if the abnormality is detected in the attachment/detachment mechanism 118 (YES in step S1002), the processing proceeds to step S1004. In step S1004, the CPU 212*a* interrupts driving of the attachment/detachment motor 603 and starts the failure diagnosis processing (FIG. 6) for the attachment/detachment mechanism 118. If the failure diagnosis processing for the attachment/detachment mechanism 118 is started, the CPU 212*a* executes failure diagnosis for the power supply portion in step S1005, failure diagnosis for the signal output portion in step S1006, and failure diagnosis for the control circuit portion in step S1007, and then identifies a failure location. The failure diagnosis processing has been described in detail above with reference to FIG. 6, and thus the description thereof is omitted.

In step S1008, the CPU 212*a* determines whether the failure location is identified in electric failure diagnosis processing for the attachment/detachment mechanism 118. In step S1008, if the failure location cannot be identified (NO in step S1008), the processing proceeds to step S1009. In step S1009, the CPU 212*a* executes failure diagnosis processing for a load portion. The failure diagnosis processing for the load portion is processing for determining whether a failure has occurred in the home position detection sensor 242 based on a reading from the density sensor 112. When the failure diagnosis processing for the load portion is started, in step S1010, the CPU 212*a* drives the attachment/detachment motor 603, and in step S1011, the CPU 212*a* obtains the reading from the density sensor 112.

In this case, the reading from the density sensor 112 varies depending on a distance between the density sensor 112 and the intermediate transfer belt 108. In other words, the reading from the density sensor 112 varies depending on the attachment/detachment position of the intermediate transfer belt attachment/detachment mechanism 118. Accordingly, when the attachment/detachment position is normally switched, the reading from the density sensor 112 in the separation state, the reading from the density sensor 112 in the first contact state, and the reading from the density sensor 112 in the second contact state ought to indicate different values.

Accordingly, in step S1012, the CPU 212*a* takes a sample of the reading from the density sensor 112 during a predetermined period, and determines whether the reading is changed by a predetermined value or more. If the reading is changed by the predetermined value or more (YES in step S1012), this change indicates that the attachment/detachment mechanism 118 is performing an attachment/detachment operation but the detection signal is not normally output from the home position detection sensor 242. Therefore, if the reading from the density sensor 112 is changed by the predetermined value or more in step S1012 (YES in step S1012), the processing proceeds to step S1013. In step S1013, the CPU 212*a* identifies the home position detection sensor 242 as the failure location.

On the other hand, if the reading from the density sensor 112 is not changed by the predetermined value or more, the attachment; detachment mechanism 118 is not normally executing the attachment/detachment operation. Accordingly, if the reading from the density sensor 112 is not changed by the predetermined value or more in step S1012 (NO in step S1012), the processing proceeds to step S1014. In step S1014, the CPU 212*a* identifies a drive transmission mechanism of the attachment/detachment mechanism 118 as the failure location.

In step S1015, the CPU 212*a* displays a screen for notifying the failure location on the display of the operation panel 1000, and then terminates the failure diagnosis processing for the attachment/detachment mechanism 118.

In the failure diagnosis processing for the attachment/detachment mechanism 118, if the print sheet S remains in a movable portion which is driven for attachment/detachment operation, the print sheet S may be damaged. Therefore, in the second failure diagnosis processing, it nay be desirable to prompt the user through the operation panel 1000 to remove the print sheet S remaining in the image forming portion 3 before the failure diagnosis processing is executed.

(Failure Diagnosis Start Timing Control)

Figure 11:
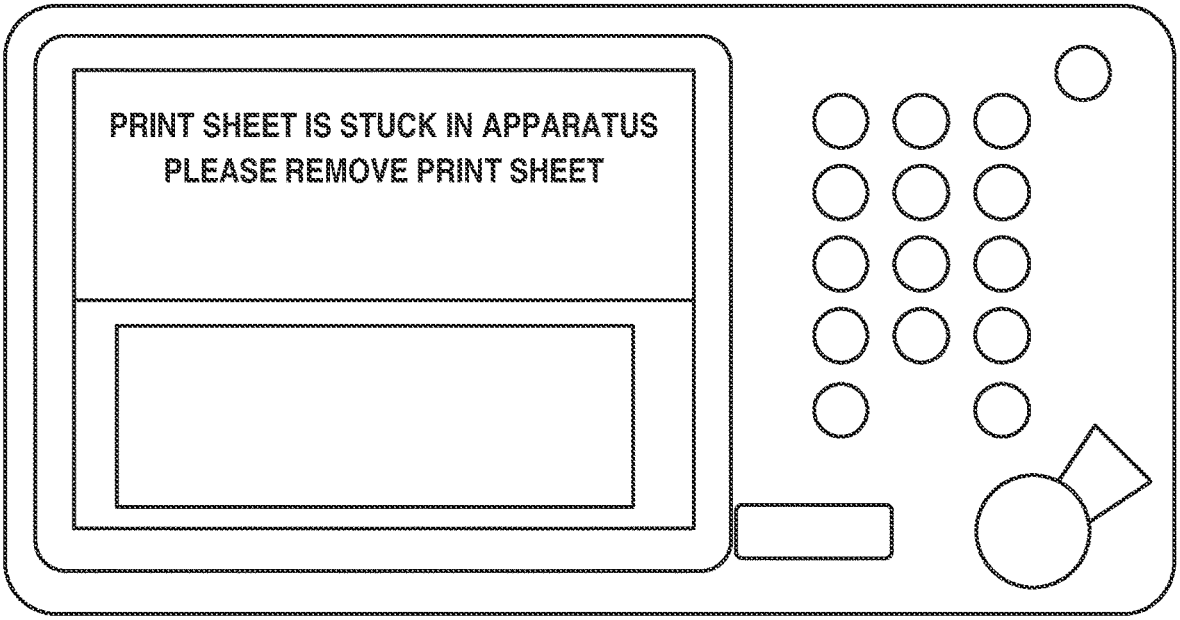
FIG. 11 illustrates a display example of a screen to be displayed on an operation panel.
Figure 13:
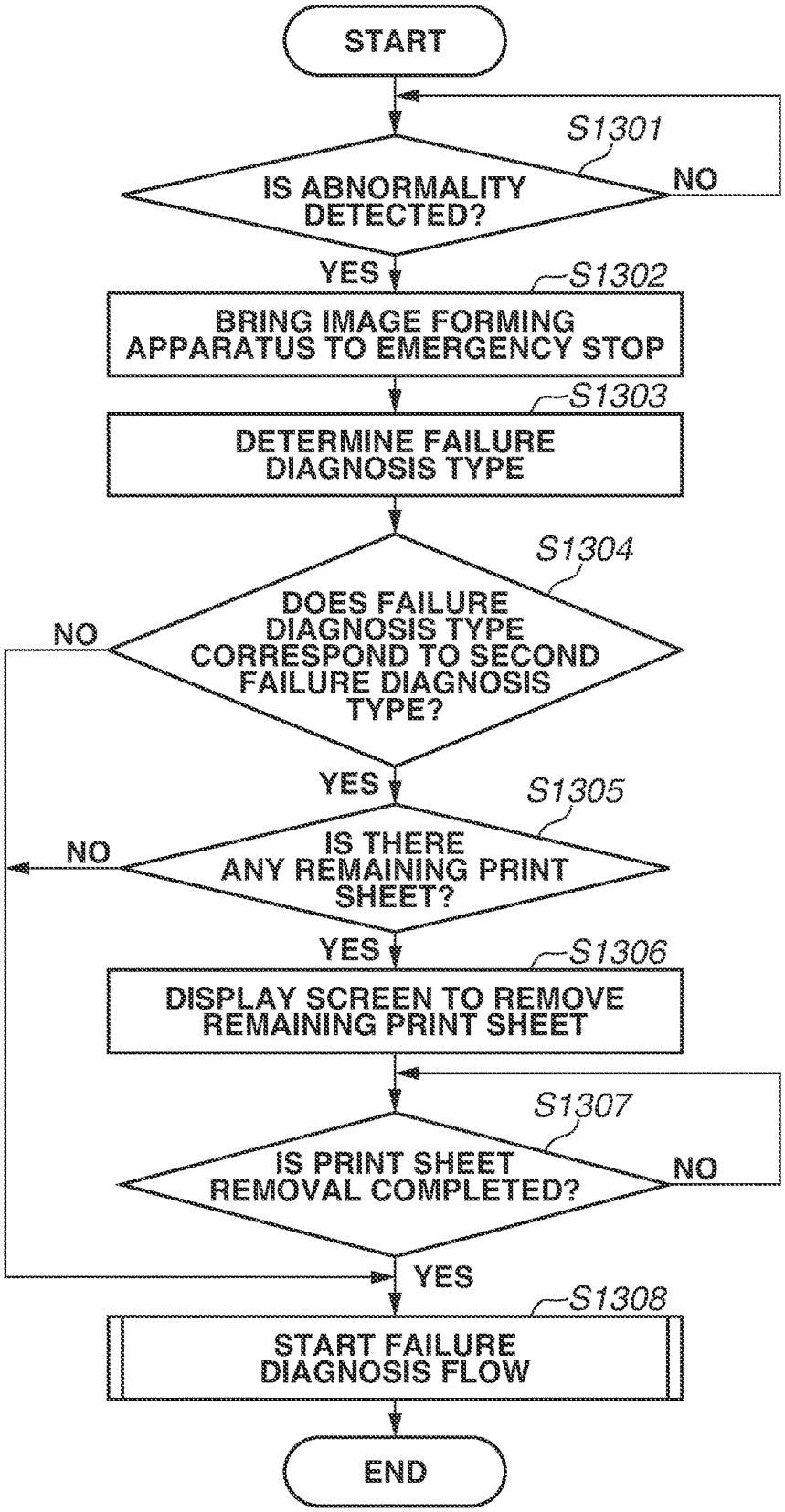
FIG. 13 is a flowchart illustrating failure diagnosis processing including jammed sheet removal processing.

Next, the failure diagnosis processing including jammed sheet removal processing described above will be described with reference to a flowchart illustrated in FIG. 13 and an screen example of the operation panel 1000 as illustrated in FIG. 11. In step S1301, the CPU 212*a* waits until the abnormality is detected based on signal values from the sensors and the motor of the image forming apparatus 1. In step S1301, if the abnormality is detected (YES in step S1301), the processing proceeds to step S1302. In step S1302, the CPU 212*a* brings the operation of the image forming apparatus 1 into emergency stop. After the operation of the image forming apparatus 1 is interrupted, in step S1303, the CPU 212*a* determines the failure diagnosis type corresponding to the content of the abnormality by referring to a table illustrating a correspondence relationship between error codes and failure diagnosis types as illustrated in FIG. 12.

Next, in step S1304, the CPU 212*a* determines whether the failure diagnosis type determined in step S1303 corresponds to the second failure diagnosis type, in step S1304, if the failure diagnosis type corresponds to the first failure diagnosis type (NO in step S1304), the processing proceeds to step S1308. In step S1308, the CPU 212*a* executes the failure diagnosis processing regardless of whether the print sheet S (jammed sheet) remains in the conveyance path, and terminates the failure diagnosis processing. This is because it is less likely that the print sheet S may be damaged when the failure diagnosis processing of the first failure diagnosis type is executed in the state there the print sheet S remains in the conveyance path of the image forming portion 3. If the failure location is identified in the failure diagnosis processing in step S1308, the CPU 212*a* displays a screen for notifying the failure location on the display of the operation panel 1000.

On the other hand, in step S1304, if it is determined that the failure diagnosis type corresponds to the second failure diagnosis type (YES in step S1304), the processing proceeds to step S1305. In step S1305, the CPU 212*a* determines whether the print sheet S remains in the conveyance path of the image forming portion 3. In step S1305, the CPU 212*a* determines whether the print sheet S remains in the conveyance path, for example, based on output values from the sensors, which are provided in the image forming apparatus 1, before the image forming apparatus 1 is brought into emergency stop. If the print sheet S does not remain in the conveyance path (NC) in step S1305), the processing proceeds to step S1308. In step S1308, the CPU 212*a* executes the failure diagnosis processing.

In step S1305, if it is determined that the print sheet S remains in the conveyance path (YES in step S1305), the processing proceeds to step S1306. In step S1306, the CPU 212*a* displays a screen for prompting the user to remove the print sheet S remaining in the conveyance path on the display of the operation panel 1000. FIG. II illustrates an example of the screen to be produced on the display in step S1306. Next, in step S1307, the CPU 212*a* waits until the print sheet S remaining in the conveyance path is removed. In step S1307, when the detection result of the opening/closing detection sensor 123 changes from the closed state to the opened state and then changes from the opened state to the closed state (YES in step S1307), the processing proceeds to step S1308. In step S1308, the CPU 212*a* executes the failure diagnosis processing. If the detection result of the opening/closing detection sensor 123 changes as described above, it is more likely that the print sheet S remaining in the conveyance path has been removed by the user or service person.

Instead of the above, in step S1307, the CPU 212*a* may execute the failure diagnosis processing based not on a change in the detection result of the opening/closing detection sensor 123, but on a change in the detection result of the opening/closing detection sensor 124, i.e., when the detection result of the opening/closing detection sensor 124 changes from the closed state to the opened state and then changes from the opened state to the closed state.

Further, the failure diagnosis processing of the first failure diagnosis type in which the failure diagnosis processing is executed even in the state where the print sheet S remains in the image forming portion 3 may be not only the failure diagnosis processing for the developing unit 105, but also failure diagnosis processing for the fixing unit 19. The failure diagnosis processing of the first failure diagnosis type is not limited to the failure diagnosis processing for the developing unit 105. The failure diagnosis processing of the second failure diagnosis type is not limited to the failure diagnosis processing for the attachment/detachment mechanism 118.

Figure 16:
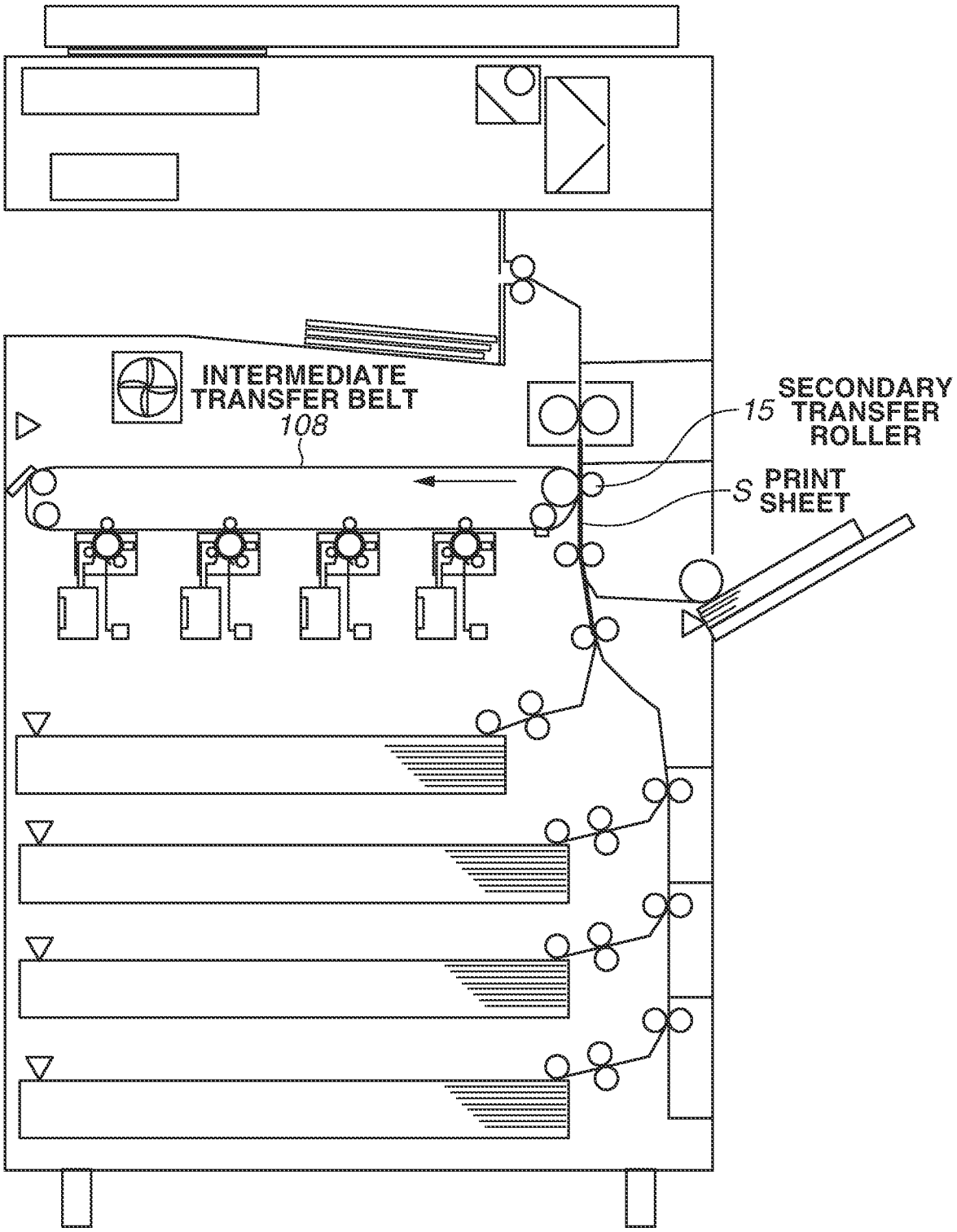
FIG. 16 is a schematic sectional view illustrating the image forming apparatus in which a jammed sheet remains.

Further, the image forming apparatus 1 may have a structure for prompting the user to remove the remaining print sheet S only when the print sheet S is present at a portion (transfer nip portion) between the intermediate transfer belt 108 and the secondary transfer roller 15 as illustrated in FIG. 16. In this structure, if the print sheet S remains at a location other than the transfer nip portion, the CPU 212*a* starts the failure diagnosis flow without prompting the user to remove the print sheet S.

As described above, the image forming apparatus 1 determines the failure diagnosis type depending on the contents of the executed failure diagnosis flow, and determines, based on the determined failure diagnosis type, whether the failure diagnosis flow can be executed when any cover is opened, and then prompts the user to remove the remaining print sheet S, as needed. Consequently, it is possible to prevent the print sheet S remaining in the conveyance path from being damaged even when the failure diagnosis flow is executed.

According to an aspect of the present disclosure, it is possible to prevent damage to a sheet remaining in the conveyance path of the image forming apparatus 1 and to prevent damage to the image forming apparatus 1 when failure diagnosis processing is executed.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random access memory (RAM), a read-only memory (ROM), a storage of distributed computing systems, an optical disk (such as a compact disc (CD), digital versatile disc (MID), or Blu-ray Disc (BD)™) a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-007380, filed Jan. 18, 2019, which is hereby incorporated by reference herein in its entirety,

What is claimed is:

1. An image forming apparatus comprising:

a conveyance unit configured to convey a sheet along a conveyance path;

an image forming unit configured to form an image on the sheet; and a controller configured to perform operations including:

detecting whether a first abnormality has occurred in the image forming apparatus, controlling the conveyance unit to stop conveyance by the conveyance unit in a case where the first abnormality is detected, executing first determining processing for determining a failure portion that is a cause of the first abnormality, detecting whether a second abnormality has occurred in the image forming apparatus, controlling the conveyance unit to stop conveyance by the conveyance unit in a case where the second abnormality is detected, and executing second determining processing for determining a failure portion that is a cause of the second abnormality, wherein executing the first determining processing includes executing the first determining processing without outputting announce information for prompting removal of a sheet remaining in the conveyance path, and wherein the controller outputs the announce information and executes the second determining processing.

2. The image forming apparatus according to claim 1, further comprising a power supply unit configured to supply power to the conveyance unit and to the image forming unit, wherein the first determining processing includes processing for diagnosing a failure in the power supply unit, and wherein second determining processing includes the processing for diagnosing a failure in the power supply unit.

3. The image forming apparatus according to claim 1, wherein the image forming unit includes:

a photosensitive member, an exposure device configured to form an electrostatic latent image on the photosensitive member, and a development device configured to develop the electrostatic latent image, and wherein the first abnormality includes an abnormality of the development device.

4. The image forming apparatus according to claim 1, further comprising:

a mechanism configured to control an intermediate transfer member to enter a first state and a second state; and a sensor configured to detect a state of the mechanism, wherein the image forming unit includes a plurality of photosensitive members, the intermediate transfer member onto which the image is to be transferred, and a transfer unit configured to transfer the image from the intermediate transfer member to the sheet, wherein the first state is a state in which the intermediate transfer member contacts the plurality of photosensitive members, and the second state is a state in which the intermediate transfer member is separated from the plurality of photosensitive members, and wherein the second abnormality includes an abnormality of the state of the mechanism based on a result of detection by the sensor.

5. The image forming apparatus according to claim 1, wherein the controller outputs first result information related to a result of the first determining processing, and wherein the controller outputs second result information related to a result of the second determining processing.

6. The image forming apparatus according to claim 1, wherein the controller outputs the announce information before executing the second determining processing.

7. The image forming apparatus according to claim 1, wherein the image forming unit includes a fixing unit configured to fix the image onto the sheet, and includes a motor configured to drive the fixing unit, and wherein the first abnormality includes abnormal rotation of the motor.

8. The image forming apparatus according to claim 1, wherein the image forming unit includes:

a photosensitive member, an exposure device configured to expose the photosensitive member to form an electrostatic latent image on the photosensitive member, a development device configured to develop the electrostatic latent image, and a motor configured to rotate the photosensitive member, and wherein the first abnormality includes abnormal rotation of the motor.

9. The image forming apparatus according to claim 1 further comprising a fan configured to release heat inside the image forming apparatus to outside, wherein the first abnormality includes an abnormality of the fan.

10. An image forming apparatus comprising:

an image forming unit configured to form an image on a sheet conveyed in a conveyance path; and a controller configured to perform operations including:

detecting whether a first abnormality has occurred, stop conveyance the sheet when the first abnormality is detected, executing first determining processing for determining a failure portion that is a cause of the first abnormality, wherein, in a case where the first abnormality is detected, outputting first information for prompting notification of a failure regarding the first abnormality to a service person, detecting whether a second abnormality, different from the first abnormality, has occurred, stop conveyance the sheet when the second abnormality is detected, outputting announce information for prompting removal of a sheet remaining in the conveyance path in a case where the second abnormality is detected, executing second determining processing for determining a failure portion that is a cause of the second abnormality, wherein, in a case where the second abnormality is detected, outputting second information for prompting notification of a failure regarding the second abnormality to the service person, and wherein the controller executes, in a case where the first abnormality is detected, the first determining processing without outputting announce information for prompting removal of a sheet remaining in the conveyance path.

11. The image forming apparatus according to claim 10, further comprising a power supply unit configured to supply power to the image forming unit, wherein the first determining processing includes processing for diagnosing a failure in the power supply unit, and wherein the second determining processing includes the processing for diagnosing a failure in the power supply unit.

12. The image forming apparatus according to claim 10, wherein the image forming unit includes:

a photosensitive member, an exposure device configured to form an electrostatic latent image on the photosensitive member, and a development device configured to develop the electrostatic latent image, and wherein the first abnormality includes an abnormality of the development device.

13. The image forming apparatus according to claim 10, further comprising:

a mechanism configured to control an intermediate transfer member to enter a first state and a second state; and a sensor configured to detect a state of the mechanism, wherein the image forming unit includes a plurality of photosensitive members, the intermediate transfer member onto which the image is to be transferred, and a transfer unit configured to transfer the image from the intermediate transfer member to the sheet, wherein the first state is a state in which the intermediate transfer member contacts the plurality of photosensitive members, and the second state is a state in which the intermediate transfer member is separated from the plurality of photosensitive members, and wherein the second abnormality includes an abnormality of the state of the mechanism based on a result of detection by the sensor.

14. The image forming apparatus according to claim 10, wherein the controller outputs first result information related to a result of the first determining processing, and wherein the controller outputs second result information related to a result of the second determining processing.

15. The image forming apparatus according to claim 10, wherein the controller outputs the announce information before executing the second determining processing.

16. The image forming apparatus according to claim 10, wherein the image forming unit includes a fixing unit configured to fix the image onto the sheet, and includes a motor configured to drive the fixing unit, and wherein the first abnormality includes abnormal rotation of the motor.

17. The image forming apparatus according to claim 10, wherein the image forming unit includes:

a photosensitive member, an exposure device configured to expose the photosensitive member to form an electrostatic latent image on the photosensitive member, a development device configured to develop the electrostatic latent image, and a motor configured to rotate the photosensitive member, and wherein the first abnormality includes abnormal rotation of the motor.

18. The image forming apparatus according to claim 10 further comprising a fan configured to release heat inside the image forming apparatus to outside, wherein the first abnormality includes an abnormality of the fan.

* * * * *